US005093688A

United States Patent [19]

Komiya et al.

[11] Patent Number: 5,093,688

[45] Date of Patent: Mar. 3, 1992

[54] IMAGE FORMING PROCESS CONTROL METHOD AND APPARATUS

[75] Inventors: Yutaka Komiya, Tokyo; Katsumi Murakami, Kawasaki; Tsuneki Inuzuka, Machida; Hisashi Sakamaki, Yokohama, all of Japan

[73] Assignee: Canon Kabushiki Kaisha, Tokyo, Japan

[21] Appl. No.: 588,935

[22] Filed: Sep. 27, 1990

Related U.S. Application Data

[60] Division of Ser. No. 512,537, Apr. 18, 1990, which is a continuation of Ser. No. 291,365, Dec. 30, 1988, abandoned, which is a continuation of Ser. No. 193,145, May 5, 1988, abandoned, which is a continuation of Ser. No. 58,327, Jun. 4, 1987, abandoned, which is a division of Ser. No. 771,302, Aug. 30, 1985, Pat. No. 4,671,647, which is a division of Ser. No. 425,706, Sep. 28, 1982, Pat. No. 4,551,587, which is a division of Ser. No. 156,645, Jun. 5, 1980, Pat. No. 4,456,366, which is a continuation of Ser. No. 910,831, May 30, 1978, abandoned.

[30] Foreign Application Priority Data

| | | | |
|---|---|---|---|
| May 31, 1977 | [JP] | Japan | 52-64528 |
| May 31, 1977 | [JP] | Japan | 52-64529 |
| May 31, 1977 | [JP] | Japan | 52-64530 |

[51] Int. Cl.[5] ..... G03G 15/00

[52] U.S. Cl. ..... 355/204; 355/208

[58] Field of Search ..... 355/204, 208, 210, 308, 355/309

[56] References Cited

U.S. PATENT DOCUMENTS

| | | | |
|---|---|---|---|
| 3,936,182 | 2/1976 | Sheikh | 355/204 |
| 3,944,360 | 3/1976 | Deetz et al. | 355/310 |
| 4,054,380 | 10/1977 | Donohue | 355/14 |
| 4,314,754 | 2/1982 | Shimizu | 355/14 C |
| 4,816,868 | 3/1989 | Shimizu | 355/14 C |

OTHER PUBLICATIONS

Hubbard et al., IBM Technical Disclosure Bulletin, vol. 19, No. 3 (Aug. 1976) pp. 1818-1820.

*Primary Examiner*—R. L. Moses

*Attorney, Agent, or Firm*—Fitzpatrick, Cella, Harper & Scinto

[57] ABSTRACT

An image processing apparatus including an image processing unit, computer controller with a memory for storing a program for controlling the processing unit, clock pulse generator for executing the stored computer control program and a divider for dividing the generated clock pulses. The computer controller also receives and counts the clock pulses divided by the divider and controls the processing sequence in accordance with the count.

8 Claims, 39 Drawing Sheets

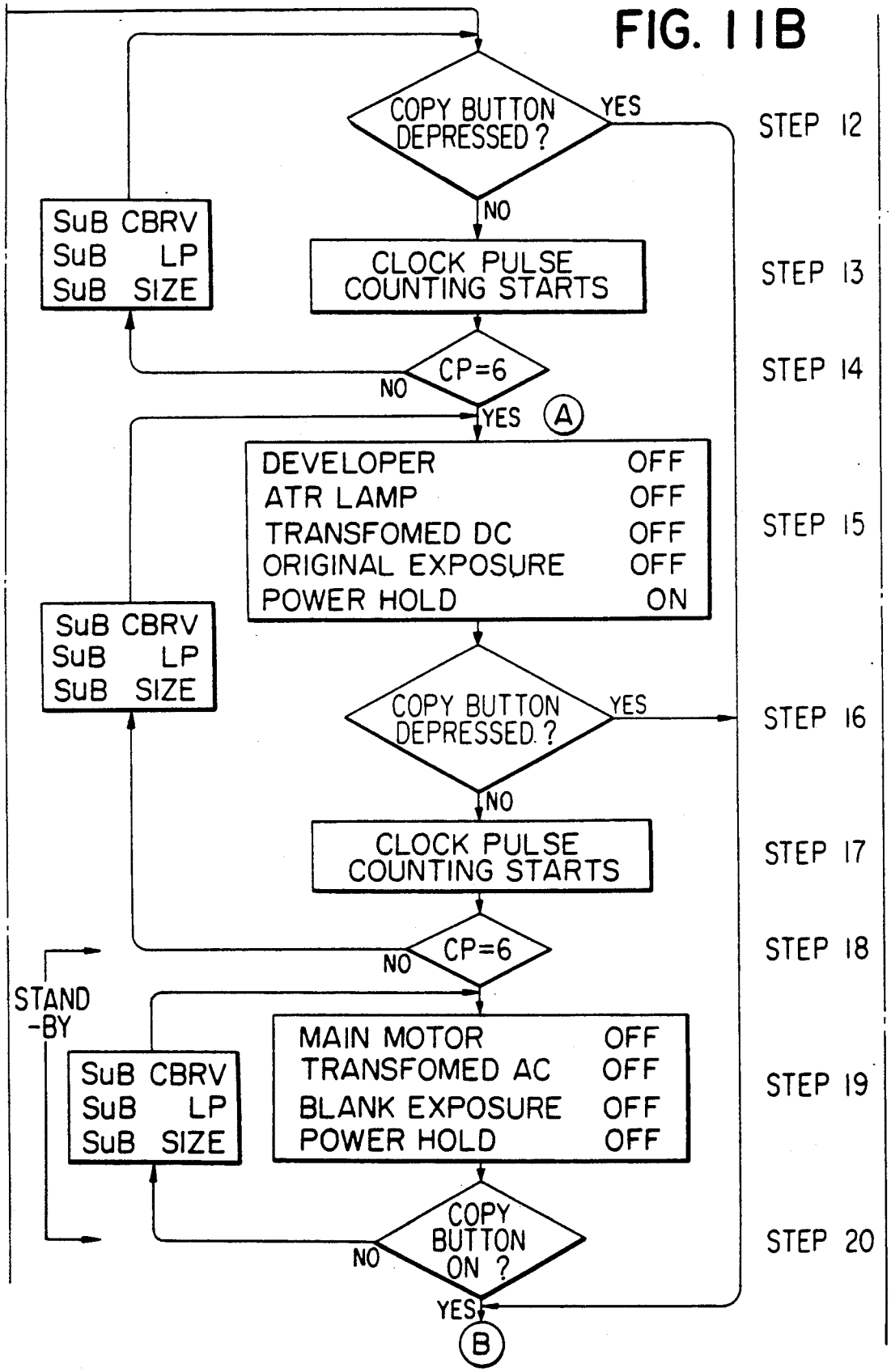
FIG. 11B
COPY BUTTON DEPRESSED ?
YES
NO
STEP 12
SuB CBRV
SuB LP
SuB SIZE
CLOCK PULSE COUNTING STARTS
STEP 13
CP=6
NO
YES
A
STEP 14
DEVELOPER OFF
ATR LAMP OFF
TRANSFOMED DC OFF
ORIGINAL EXPOSURE OFF
POWER HOLD ON
STEP 15
SuB CBRV
SuB LP
SuB SIZE
COPY BUTTON DEPRESSED ?
YES
NO
STEP 16
CLOCK PULSE COUNTING STARTS
STEP 17
CP=6
NO
STEP 18
STAND -BY
SuB CBRV
SuB LP
SuB SIZE
MAIN MOTOR OFF
TRANSFOMED AC OFF
BLANK EXPOSURE OFF
POWER HOLD OFF
STEP 19
COPY BUTTON ON ?
NO
YES
B
STEP 20

I
COPY BUTTON DEPRESSED ?
YES
J
STEP 39
NO
SuB TSSD
SuB SIZE
SuB LP
CLOCK PULSE COUNTING STARTS
STEP 40
NO
CP=2
STEP 41
YES
COPY BUTTON DEPRESSED ?
YES
K
STEP 42
NO
SuB CBRV
SuB SIZE
SuB LP
CLOCK PULSE COUNTING STARTS
STEP 43
NO
CP=3
STEP 44
YES
SuB PDP 1
STEP 45
COPY BUTTON DEPRESSED ?
YES
L
STEP 46
NO
SuB CBRV
SuB SIZE
SuB LP
CLOCK PULSE COUNTING STARTS
STEP 47
NO
CP=4
STEP 48
YES
SuB PDP 2
STEP 49
SuB TEL
STEP 50
A

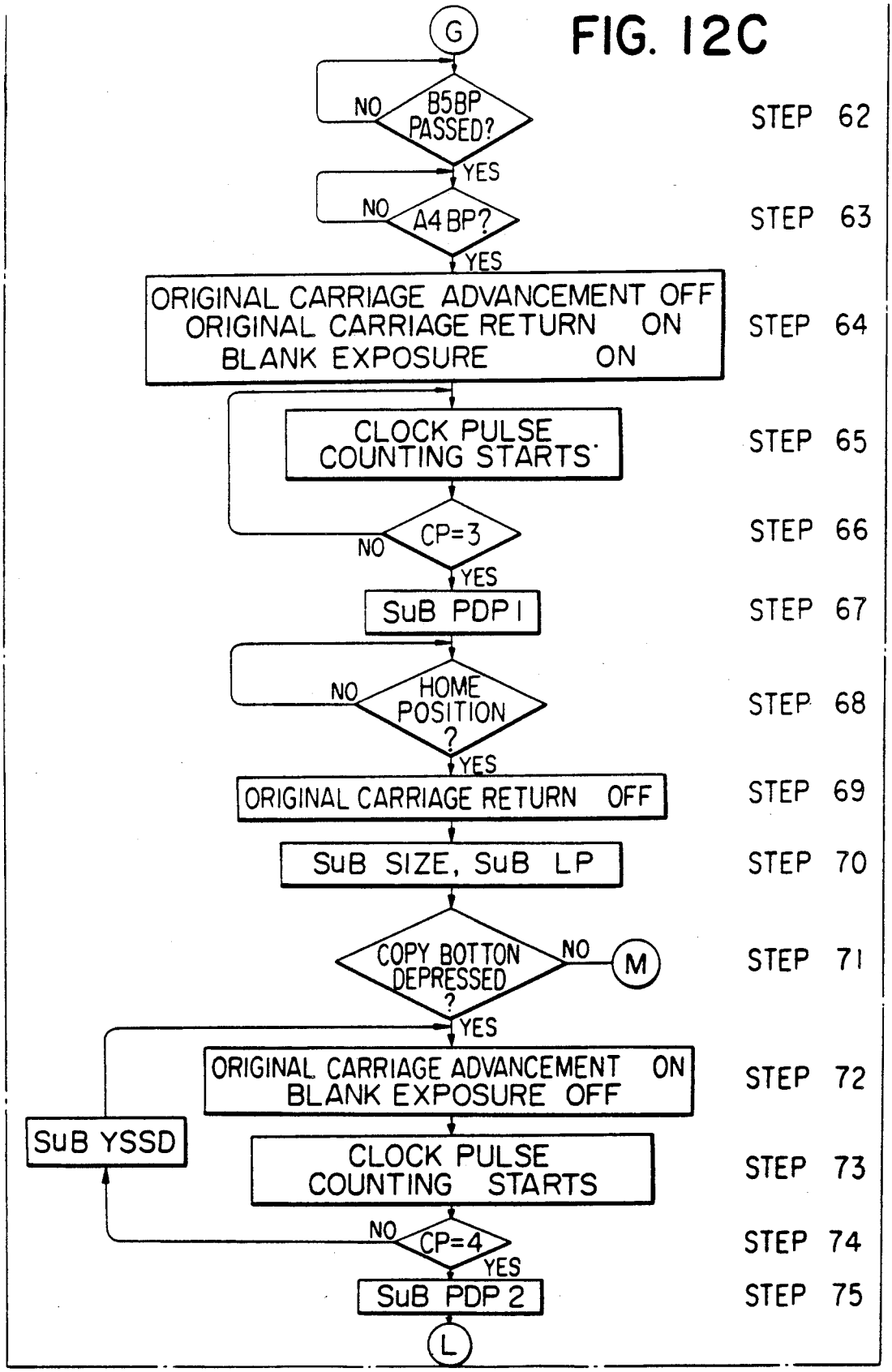
FIG. 12C
G
B5BP PASSED?
NO
YES
STEP 62
A4 BP?
NO
YES
STEP 63
ORIGINAL CARRIAGE ADVANCEMENT OFF
ORIGINAL CARRIAGE RETURN ON
BLANK EXPOSURE ON
STEP 64
CLOCK PULSE COUNTING STARTS
STEP 65
CP=3
NO
YES
STEP 66
SuB PDP 1
STEP 67
HOME POSITION ?
NO
YES
STEP 68
ORIGINAL CARRIAGE RETURN OFF
STEP 69
SuB SIZE, SuB LP
STEP 70
COPY BOTTON DEPRESSED ?
NO
M
YES
STEP 71
ORIGINAL CARRIAGE ADVANCEMENT ON
BLANK EXPOSURE OFF
STEP 72
SuB YSSD
CLOCK PULSE COUNTING STARTS
STEP 73
CP=4
NO
YES
STEP 74
SuB PDP 2
STEP 75
L (IN THE CASE OF PREROTATION FOR 40 SECONDS IS EXECUTED 2)

| FIG. 14A | FIG. 14B | FIG. 14C |
|---|---|---|

(IN THE CASE THAT PREROTATION FOR 40 SECONDS IS NOT EXECUTED)

FIG. 19-2"

| FIG. 19-2' | FIG. 19-2" |
|---|---|

POWER ON
INPUT DISABLING SIGNAL
STORE IN RAM (0,n)
INPUT LEP
NO LIQUID ?
NO
YES
RAM(0,n)=1 ?
YES
NO
DISPLAY NO LIQUID
SUB UP
INPUT PEP
NO PAPER ?
NO
YES
RAM(0,n)=1 ?
YES
NO
DISPLAY NO PAPER
EXECUTE SEQUENCE
X
X
RAM(0,n)=1 ?
NO
YES
DISCRIMINATE JAM TIMING
JAM ?
YES
NO
A
DISPLAY JAM

IMAGE FORMING PROCESS CONTROL METHOD AND APPARATUS

This application is a division of application Ser. No. 07/512,537 filed Apr. 18, 1990, which was a continuation of application Ser. No. 07/291,365 filed Dec. 30, 1988, now abandoned, which was a continuation of application Ser. No. 07/193,145 filed May 5, 1988, now abandoned, which was a continuation of application Ser. No. 07/058,327 filed June 4, 1987, now abandoned, which was a division of application Ser. No. 06/771,302 filed Aug. 30, 1985, now U.S. Pat. No. 4,671,647, which was a division of Ser. No. 06/425,706 filed Sept. 28, 1982, now U.S. Pat. No. 4,557,587, which was a division of application Ser. No. 06/156,645 filed June 5, 1980, now U.S. Pat. No. 4,456,366, which was a continuation of application Ser. No. 05/910,831 filed May 30, 1978, now abandoned.

BACKGROUND OF THE INVENTION

1. Field of the Invention

The present invention relates to an image forming apparatus adapted for use for example in a copier.

2. Description of the Prior Art

In an example of the copying process for a copier wherein the present invention is applicable as disclosed in the U.S. Pat. Nos. 3,666,363 and 4,071,361, the surface of a photosensitive drum provided with a photosensitive element consisting of an electroconductive layer, a photoconductive layer and an insulating layer is subjected to a uniform precharging (for example positive charging) by means of a primary charger along with the rotation of said drum, and subjected to a scanning exposure of a light image in synchronization with the displacement of an original carriage (or an optical system) simultaneously with a charge elimination by means of a recharger of an alternating current (or a direct current of a polarity opposite to that of said primary charger) thereby to form an electrostatic latent image corresponding to said light image. Said latent image is enhanced by a flush or whole-surface exposure to a higher contrast and is rendered visible in a developing station by a developer principally consisting of toner particles. The visible image thus obtained is transferred by a corona discharge of a polarity same as that of said toner (namely negative if precharging is positive) onto a transfer sheet consisting of plain paper and fixed thereon by means of a heater during transportation. On the other hand the developer particles remaining on the surface of said photosensitive drum after said transfer are removed by a cleaning blade while the retentive charge on said surface is removed by a lamp and a corona discharger to allow repetitive use of the photosensitive element. Copies of a desired number are obtained by repeating the copying process as described above.

In such process, oven though the photosensitive element is cleaned before reuse, it frequently happens that the surface of photosensitive element becomes smeared by various causes for example toner deposition when the machine is let to stand without use, such smearing being particularly marked in case of liquid development. Consequently the first image obtained after the restart of machine often appears unacceptable. Also such trouble may result from uneven potential on the surface of photosensitive element when the machine is restarted.

Also in case a same portion on the surface of photosensitive element is subjected to repeated process, there may result a local accumulation of toner or an uneven potential to deteriorate the image quality. In addition to such limited reliability of image quality, the high-speed performance and precision of process operations in the sequence control is also associated with a limited reliability. Namely in the conventional processes the control of the operation loads required for the process control has been conducted on the basis of particular surface positions of a recording element such as the photosensitive element. Consequently the control timing may become limited by the dimensions of the recording element, eventually leading to an unnecessary time loss. Also there has been required an additional circuitry in order to achieve proper timing operations according to the desired copy sizes without unnecessary functions of the process means.

Furthermore the transistor-transistor-logic circuitry which has been commonly employed for control has only a small noise margin (proportion of noise acceptable in the signal), thus being extremely sensitive to noises, particularly in copiers involving the use of high voltages. The resulting frequently use of RC filters (filters consisting of resistors and condensers) for preventing noise has inevitably resulted in an increased number of parts with a complex circuit structure. Consequently it may often result that a modification of sequence control is not achievable despite of complicated logic processing.

On the other hand the machines utilizing microcomputers have become known in recent years. However there has not been known solution for uncertain factors such as operation errors and for limitations in the machine performance in case of applying such computers to such image forming apparatus.

Furthermore the detection of paper jamming resulting from defective paper feeding, required to identify different paper sizes and to distinguish single or multiple copying, requires a complicated circuit composition and results in an undesirably low precision of detection. Also an operation error in the detection of paper jamming or paper feeding is fatal in such continuous copying apparatus, and much time has been required for designing and investigation for preventing such trouble.

Furthermore, in the operation confirmation test or heat running test without paper feeding during the course of maintenance or assembly of the machine, it becomes necessary to disable the jamming detection circuit or the circuit for detecting no paper, and the operation therefor has been cumbersome because of the independent structure of said circuits. Also in case of the transistor-transistor-logic control explained above, various timers indispensable for the control of copier have to be composed of separate circuits, which are expensive particularly in case of timers of a longer period.

SUMMARY OF THE INVENTION

The object of the present invention is to provide an image forming process and an apparatus therefor not associated with the above-mentioned drawbacks.

An another object of the present invention is to provide an image forming apparatus with improved reliability of normal functions.

A still another object of the present invention is to provide an image forming apparatus with improved reliability of the high image quality.

A still another object of the present invention is to provide an image forming apparatus with improved reliability of functions and image quality of prevent operation errors an to obtain a satisfactory image from the beginning of function even with a compact mechanism.

A still another object of the present invention is to provide an improvement on an image forming apparatus utilizing liquid development and image transfer.

A still another object of the present invention is to provide an image forming process provided with a process sequence allowing constant and satisfactory image formation.

A still another object of the present invention is to provide an image forming apparatus allowing effective use of an endless photosensitive element and allowing stable and satisfactory image formation.

A still another object of the present invention is to provide an image forming apparatus capable of performing image formation within a minimum required time according to the size of the image to be formed.

A still another object of the present invention is to provide an image forming apparatus capable of properly and exactly performing jam identification according to the different sizes of image to be formed.

A still another object of the present invention is to provide an improvement or the image forming apparatus provided with a control device utilizing a computer.

A still another object of the present invention is to provide an image forming apparatus capable of preventing operation errors of the control computer to achieve a stable control.

A still another object of the present invention is to provide an image forming apparatus capable of performing stable image formation regardless of the time during which the apparatus is out of operation.

A feature of the present invention lies in that plural standard signals are generated by an exposure scanning means such as an original carriage or an optical system to indicate the reversing position etc. thereof for forming an electrostatic latent image on a rotary member such as a photosensitive drum or belt, and a sequence control is achieved by said standard signals and a memory storing a program of control procedure of operation loads. An another feature of the present invention lies in that the pretreatment and posttreatment of the rotary member contributing to the transfer are performed according to a program memory. A still another feature of the present invention lies in that the timing control such as of stopping of the rotary member is conducted according to a program memory and taking the scanning means as a standard. A still another feature of the present invention lies in that the concentration of developer is detected with an another timing to identify the reduction in concentration. Thus the time economization and precision in operation control combined with an improved image quality can be achieved by the foregoing features.

Also with regard to the control circuit the present invention enables effective use of a limited number of ports through input control by output timing signals, achieves load control by externals signals not passing through the central processing unit (CPU) and by port output signals, and allows the use of input port for clock pulse employed as the standard for timing control and also for other functions not related with clock pulses such as for detection of ideal time of machine, thereby realizing a simplified circuit with an improved precision. Also it is possible to easily prevent the operation errors resulting from a reduced voltage supply to the control circuit utilizing a program memory, particularly the errors in the circuit provided with power hold function.

Furthermore, according to the present invention a size signal is supplied to the CPU to perform the timing control of process cycles and post-treatment according to the size, and to perform jam detection in response to the size.

The scanning to be employed in the present invention may also be achieved by a light beam scanning with a rotary element, in which case the standard signal is obtained after a predetermined scanning. Also the photosensitive element may be of a two-layered structure without the insulating layer, and the image forming process may be Carlson process.

Pre-treatment.

The photosensitivity of a photosensitive element depends on the hysteresis of exposure to light, and is therefore different in the first copy and in the second copy. Consequently, prior to the latent image formation, the photosensitive element is subjected to a flush or whole-surface exposure thereby causing a certain fatigue on said element and thus rendering the characteristics of the photosensitive element same to the first and second copies.

As toner deposition may result in the contact area between the cleaning blade and the photosensitive element if the apparatus is kept ideal after copying, and, in order to prevent this trouble, the photosensitive element is rotated prior to the copying cycle thereby cleaning the surface thereof and allowing image formation on a clean surface not showing such toner deposition.

Post-treatment.

The photosensitive element, being subjected high-voltage charging of various potentials, shows localities in the surface potential and polarity which undesirably affect the characteristics of said element if it is left in this state. It is therefore desirable to eliminate the surface charge for example by an AC corona discharge after the completion of copying cycles.

Stop Position of Rotary Member.

In a conventional mechanism wherein a rotary member, for example a conventional spliced photosensitive element, is always stopped at a determined stop position (hereinafter referred to as home position), said member is inevitably subjected to the effect of corona charging accumulating on a same portion and also to a physical deformation by the drum cleaner which is maintained in contact with the rotary member at a considerably high pressure. According to the present invention, however, the stop position of the drum, or the start position thereof, is gradually displaced by suitable clock pulse generation for each rotation of drum to prevent aforementioned cumulative effect and to allow averaged use of photosensitive member over the entire length thereof thereby maximizing the service life thereof. In the present invention, for example, there are 15.75 clock pulses generated per one rotation of photosensitive drum. In this manner, by counting 16 pulses or a multiple thereof, the drum can be stopped at a position slightly advanced from the starting position thereof after one or multiple rotations.

Also in this manner it is rendered possible to avoid the presence of unprocessed portion in the pre-and post-treatment conducted before and after the copying cycle as will be explained later thereby enabling to fully utilize the advantage of photosensitive drum formed in an endless belt and to start the copying from an arbitrary position thereof.

The foregoing and other objects of the present invention will be made apparent from the following description of the embodiments thereof.

BRIEF DESCRIPTION OF THE DRAWINGS

FIG. 18-1 is a flow chart of jam detection for a B5 size;

FIG. 18-2 is a flow chart of jam detection for a B4 size;

FIG. 18-3 is a timing chart of jam detection;

FIG. 19-1 is a diagram of an ATR circuit;

FIG. 19-2 is an ATR flow chart;

FIG. 21-1 is a diagram of an idle time measuring circuit;

FIG. 21-2 is an operation time chart of the circuit shown in FIG. 21-1;

DESCRIPTION OF THE PREFERRED EMBODIMENT

An example of the present invention applied to a copier will be explained in the following.

Figure 1:
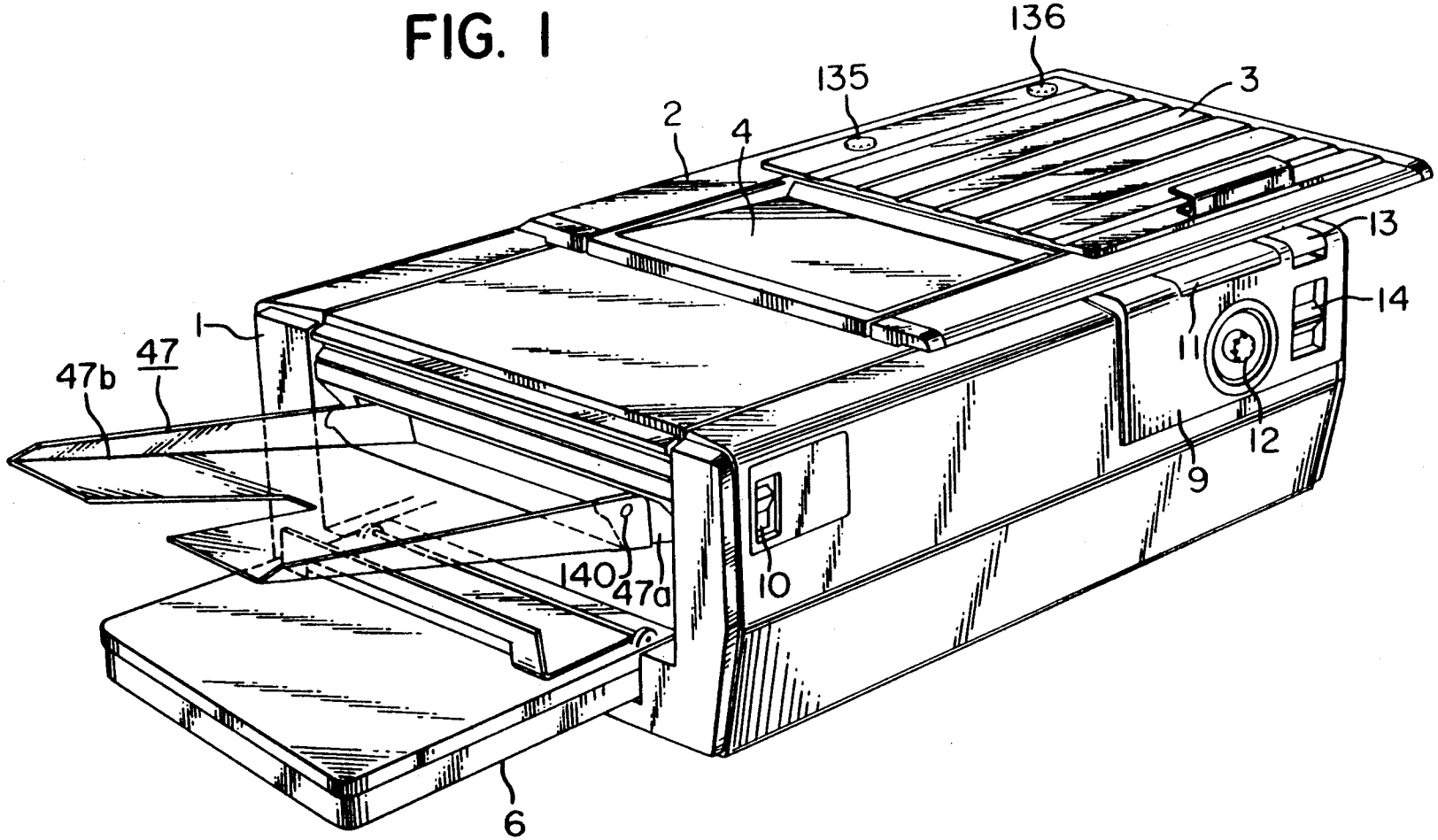
FIG. 1 is a perspective view of a copier where the present invention is applied.

Referring to FIG. 1 showing a perspective view of said copier, there are shown a main body 1, an original carriage 2, a cover 3 for pressing an original, an original receiver 4, an original supporting glass 5 (FIG. 2), a cassette 6 accommodating transfer sheets and constructed detachable from the main body 1, a control section 9, a power switch 10, copy start buttons 11, 13, a copy number setting dial 12, an image density setting switch 14, and a tray 47 for receiving ejected transfer sheets.

Figure 2:
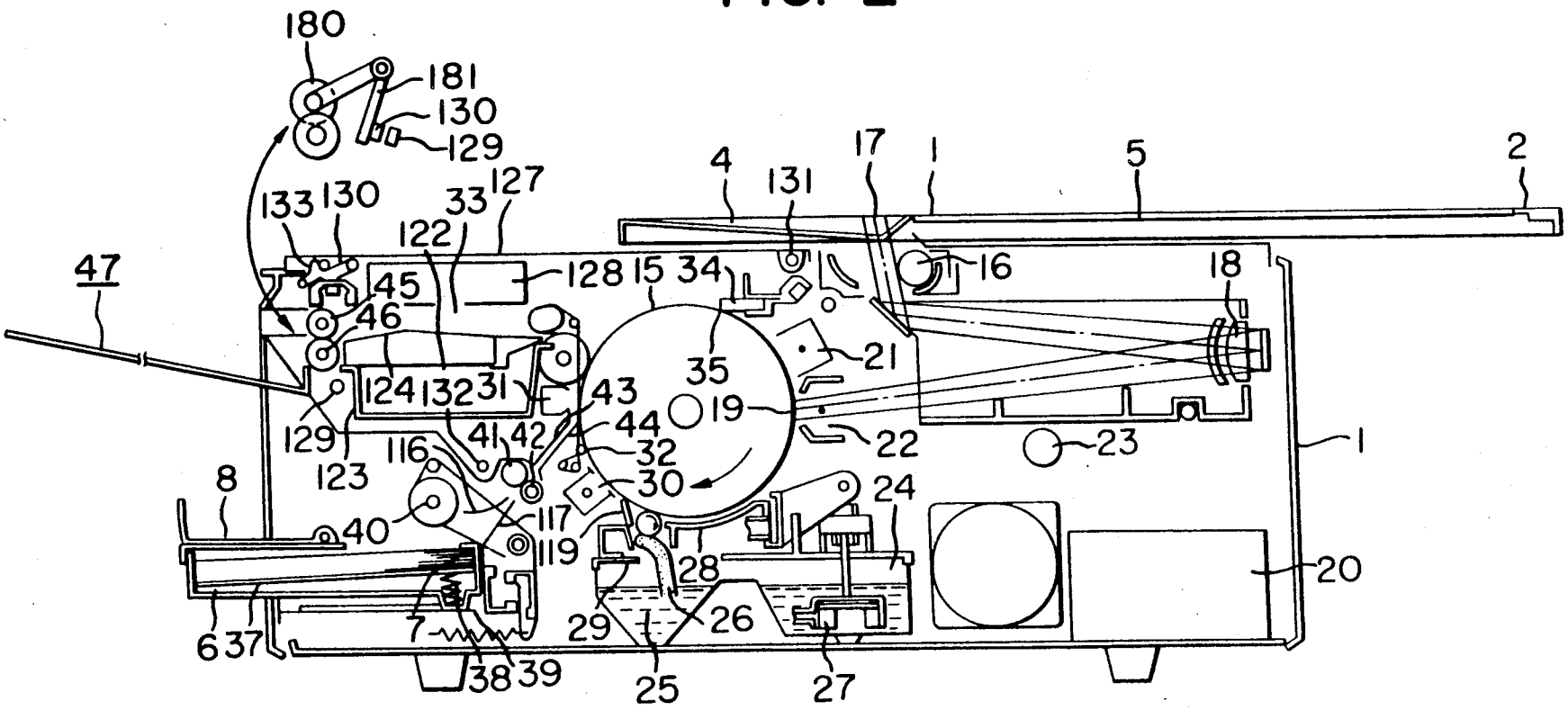
FIG. 2 is a longitudinal cross sectional view of FIG. 1.

Referring to FIG. 2 showing a cross sectional view of said copier, there are shown a photosensitive drum 15 rotated in a direction of the arrow 19 and composed of an insulating layer, a photoconductive layer and an electroconductive layer in succession from the periphery thereof, an original illuminating lamp 16 for conducting known slit scanning exposure to form a reflected image in an area of said photosensitive drum at a charger 22 through a mirror system 18, a first charger 21 for electrostatically charging the surface of said photosensitive drum 15, a second charger 22 for discharging said surface simultaneously with said exposure, a lamp 23 for providing a whole-surface exposure to said surface, a developing device 24 containing a liquid developer 25 consisting of a carrier liquid and toner particles, a charger 30 for squeezing excessive liquid developer from said surface, a transfer charger 31, a separating belt 32 for separating the transfer sheet from said photosensitive drum, and a thermal fixer 33.

The function of the above-mentioned copier is as follows. Upon turning on of the power switch 10, a digital control circuit (FIG. 6) is reset, and, after a short period for warming-up of the other electric circuits (ca. 4 seconds in this case), the photosensitive drum 15 is set in rotation. In apart of drive mechanism there is provided a clock pulse generator to generate about 16 pulses per rotation of said drum. The photosensitive drum 15 is rotated one full turn or approximately one full turn corresponding to 16 clock pulses (hereinafter represented as 16 CP). This rotation can be considered as a preliminary step for obtaining a copy of elevated quality in the copying cycle and may be omitted in certain cases. The copying cycle is conducted in continuation if the copy start button 13 is pressed in this stage, whereupon the photosensitive drum 15 is rotated corresponding to 9 CP in addition to the above-mentioned 16 CP and then the original carriage 2 with an original placed on the glass 5 starts displacement toward left (FIG. 2) and illuminated by the lamp 16 to focus an image through a mirror 17 and an in-mirror lens 18 on the drum 15 at the exposure station 19.

The photosensitive drum 15 is provided on the periphery thereof with an endless photosensitive element thereby improving the efficiency of surface utilization. The photosensitive element provided with a transparent insulating layer on the photoconductive layer, namely on the surface of drum 15, is at first subjected to a positive charging by a corona current from a positive charger 21 receiving a high voltage from a high-voltage source 20, then subjected in the exposure station 19 to a slit exposure of the image of the original illuminated by the lamp 16 simultaneously with an AC charging by an AC charger 22 receiving an AC high voltage from said source 20, then further subjected to a whole-surface exposure by the whole-surface exposure lamp 23 to form an electrostatic latent image of an elevated contrast on the drum surface, and proceeds to the succeeding developing step. The developing device 24 is composed of a container 26 for holding the liquid developer 25, a pump 27 for stirring the liquid developer and supplying said developer to the developing electrode, a developing electrode 28, and an electrode roller 29 grounded and rotated in close proximity of the drum in order to remove fogging from the developed image. The electrostatic latent image formed on the photosensitive drum 15 is developed by the toner particles present in the liquid developer 25 supplied by the pump 27 onto the developing electrode 28. Subsequently the excessive liquid developer on the photosensitive drum 15 is squeezed off by the charging by a post-charger 30 receiving a high voltage from said high-voltage source 20. Successively a transfer sheet 7 supplied from the paper feed section is brought into contact with the photosensitive drum 15, and the image thereon is transferred onto said sheet 7 by means of the electric field of a transfer charger 31 receiving a positive high voltage from said high-voltage source 20. After the transfer the transfer sheet 7 is separated by the separating belt 32 and is guided to the drying-fixing section 33. The remaining toner and liquid developer are wiped off from the photosensitive drum. 15 by the edge portion 35 of the blade cleaner 34 maintained in pressure contact with said drum, whereby the drum is rendered ready for the next cycle. The liquid developer wiped off by the blade cleaner 34 is guided, through grooves 36 (FIG. 3) provided on both ends of photosensitive drum 15, to the developing device 24 for recycled use.

It will not be explained why the original carriage 2 starts displacement only after a rotation of the photosensitive drum corresponding to 16 CP plus 9 CP upon turning on of the main switch 10. In the present copier, the use of a seamless photosensitive element on the photosensitive drum allows image formation starting from any arbitrary position of said drum. Thus, in order to increase the number of copies per unit time by avoiding unnecessary rotation as far as possible, the drum is made to perform a full turn thereby removing toner eventually remaining in the blade cleaner portion 35. In case the toner is dry and strongly sticking to the drum for example after the machine is out of use for one week, the drum is made to perform mutiple turns thereby achieving the surface cleaning prior to the start of copying cycle.

With regard to the succeeding 9 clock pulses, the first 3 pulses are utilized for the positive charging step preceding the slit exposure in the above-mentioned copying cycle and are provided in order to exclude the above-mentioned cleaner edge portion from the image area for the first copying thereby achieving a uniform and satisfactory image formation with an improved reliability. The succeeding 6 pulses are provided, as will be explained later, to prevent uneven surface potential resulting from the squeezing charger 30 and the transfer charger 31, and may be dispensed with to start copying after the above-mentioned 3 pulses if such concern is not important.

The transfer sheets 7 are accommodated in a cassette 6 of a corresponding size and detachable in the paper feed section provided at the lower left end of the main body. Upon arrival of the original carriage at a predetermined position, an actuator 161 (FIG. 4) provided on the original carriage actuates a detecting means of the main body to release a signal, by means of which a constantly rotated paper feed roller 40 is lowered and brought into contact with the uppermost transfer sheet in the cassette 6 thereby separating and advancing a sheet in cooperation with a separating claw 39. However, as the register rollers 41, 42 are stopped simultaneously with the descent of said paper feed roller 40, the leading end of the transfer sheet 7 supplied from the cassette 6 abuts with the contact portion of said register rollers 41, 42 thereby forming a slack between the guides 43, 44. Approximately when the paper feed roller is again elevated and in synchronization with the leading end of the image formed on the photosensitive drum, the register rollers 41, 42 are again put into motion to advance said transfer sheet 7 with a speed identical with the peripheral speed of said drum 15, thereby maintaining the leading ends of said image and of transfer sheet in register.

Now there will be given an explanation on the displacement of the original carriage. Upon actuation of the copy start button 13 (FIG. 1) with an original to be copied placed on the glass 5 with the leading end of said original in register with the leading end A of said glass, said original maintained in place by a cover 3 (FIG. 1), the drum is put into rotation on initiate the copying cycle. Upon receipt of an original carriage start signal from the clock pulse generator after said 9 CP, the original carriage 2 starts displacement to the left-hand side in FIG. 1 in synchronization with the peripheral speed of the photosensitive drum 15 to perform slit exposure. Upon completion of the exposure the original carriage 2 terminates said leftward displacement in response to a signal corresponding to the paper size contained in the cassette and also in response to a signal indicating the arrival of the carriage 2 itself to a predetermined position, and immediately reversed to the opposite direction, i.e. to the right. The time required for said reversing, being a loss time in the copying, should desirably be as short as possible. In the present embodiment the reversing speed is selected four times as large as that of forward displacement to improve the copying efficiency. The shock at the stopping, apt to be caused by such high reversing speed, is absorbed by a braking mechanism in the present embodiment whereby the original carriage 2 being promptly stopped at a predetermined position. A continuous mutiple copying from a same original can be easily conducted by a counter device (not shown) connected with said copy start button 13. In case of such continuous copying the original carriage 2 is immediately restarted after the stopping thereof at said position. The copy start button is maintained in the closed state until the supply of transfer sheets of a number determined by the copy number setting dial 12 (FIG. 1) is completed. The copier of the present embodiment is designed to be capable of copying various sizes from a maximum B4 size to a minimum B5 size. In such case there will result a lower number of copies per unit time with significant time loss if the reciprocating motion of the original carriage 2 is performed over a distance corresponding to the maximum copy size B4 regardless of the actual copy size. In the present embodiment, therefore, there are provided plural members 48A, B, C (FIG. 4) for generating carriage reversing signals corresponding to different copy sizes (for example A4, B5 etc.) to modify the copying cycle according to the desired copy size thereby improving the copying efficiency. Such different cycles are selected by a signal from the cassette 6 classified by the size.

Now there will be explained the stand-by state after the copying cycle and the re-start procedure thereafter.

It is not desirable for the service life of the photosensitive drum 15 and the blade cleaner 34 if said drum is maintained in rotation and the high-voltage source is in function after the completion of the copying operation while the main switch is still maintained on. In the present embodiment, therefore, the drum automatically stops and enters a stand-by state, even if the main switch 10 is still on, when the succeeding copying operation is not commenced within a predetermined period after the completion of the preceding copying operation. Said period is selected longer than a period required for cleaning the entire surface of the photosensitive drum 15 after the ejection of the final transfer sheet 7. Copying operation can be restarted from this stand-by state by the actuation of the copy start button 13, which restores the state prior to the stand-by state, initiating the drum rotation and the displacement of original carriage 2 after 9 CP, and restarting the function of high-voltage source 20.

Prior to the actuation of copy start button 13, the photosensitive element 15 is maintained at a homogeneous potential by means of the AC charger 22. Upon actuation of said button 13 to start the functions of negative charger 30 and positive transfer charger 31 simultaneously with the rotation of photosensitive drum 15, a portion between said chargers is subjected to a negative charging which is neutralized after said portion by the positive charger 31. Consequently there will be formed a drastic potential change on the photosensitive element 15 in an area located close to the negative charger 30, and such area, if included in the image area, will undesirably effect the image quality.

The aforementioned 9 clock pulses correspond to the distance from the AC charger 22 defining the start of image formation to said negative charger 30 and are selected in order to prevent the above-mentioned undesirable effect on the image quality.

Figure 3:
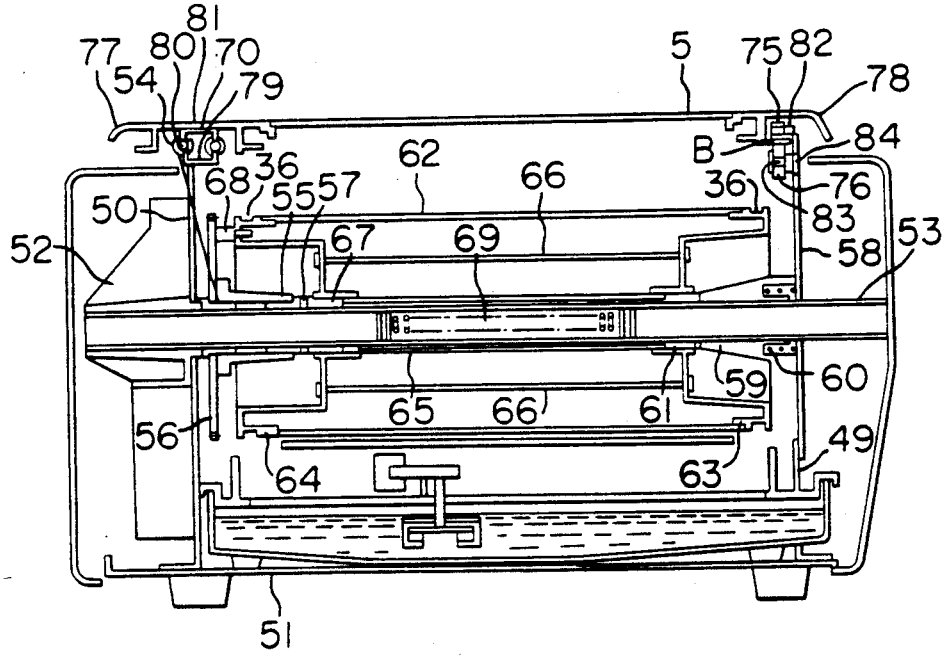
FIG. 3 is a transversal cross sectional view of FIG. 1.

FIG. 3 is a cross-sectional view parallel to the drum 15 (62), wherein there are shown a guide rail 70 enabling the displacement of the original carriage 59, guide rollers 75, 76, and a frame 50 for supporting various detecting elements.

Figure 4:
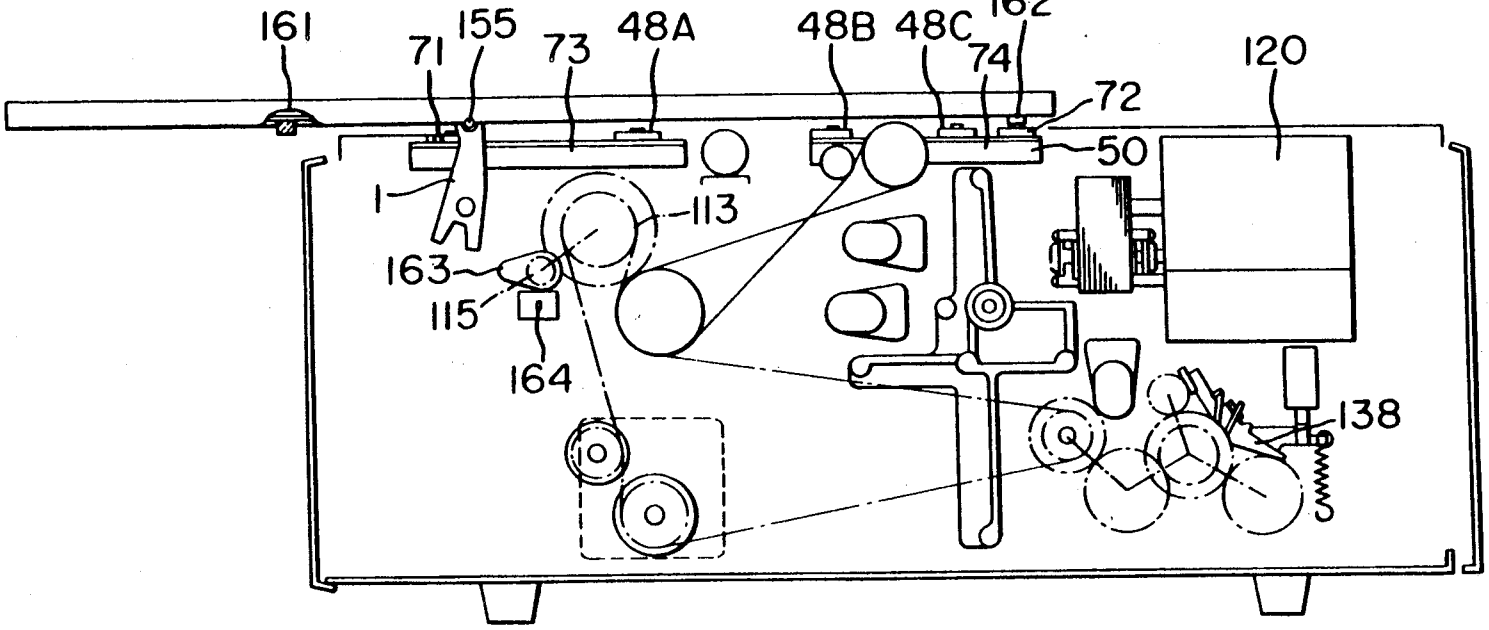
FIG. 4 is a cross sectional view showing the drive mechanism of the copier.

Now referring to FIG. 4 showing the drive system and the signal generating system, on the rear frame 50 there are affixed members 73, 74 (for example print circuit boards) for supporting magnetic detecting elements 48, 71, 72 for control signals. Also on the supports 73, 74 for the guide rail there are provided magnetic detecting elements 48A, 71, 72, 48B, 48C which generate control signals in succession and in cooperation with two magnets 161, 162 mounted on the original carriage 2, the use of said two magnets being advantageous for obtaining various signals within a compact body. Upon actuation of the copy start button and start of forward displacement of the original carriage 2, there is generated at first a paper feed signal by the magnet 161 and the element 71. Then, upon completion of the exposure of a copy size B5, A4 or B5 along said forward displacement and upon arrival of the magnet 161 at the element 48A, B or C, there is generated a reverse signal to initiate the reversing displacement of the carriage 2. Upon arrival of the magnet 162 at the element 72 along said reversing displacement, there is released a stop signal to stop the carriage 2 at a predetermined position. A size change is instructed by the cassette 6.

The clock pulse generating mechanism comprises a sprocket wheel 112 which is driven through a chain 86 by a sprocket wheel 85 connected to a main motor M1 and which is made integral with a gear 113, said gear engaging with a gear 115 mounted to an arm 114 supporting a clock pulse generating magnet 163 to rotate said magnet thereby generating, in cooperation with a magnetic detecting element 164 mounted on the rear frame 50, clock pulses of a constant interval in synchronization with the rotation speed of said main motor M1.

The clock pulse generating mechanism comprises a sprocket wheel 112 which is driven through a chain 86 by a sprocket wheel 85 connected to a main motor M1 and which is made integral with a gear 113, said gear engaging with a gear 115 mounted to an arm 114 supporting a clock pulse generating magnet 163 to rotate said magnet thereby generating, in cooperation with a magnetic detecting element 164 mounted on the rear frame 50, clock pulses of a constant interval in synchronization with the rotation speed of said main motor M1.

Now there will explained the function in case of a defective paper feeding. The copier of the present embodiment is provided with jam detecting means to confirm if the transfer sheet completes the determined steps (paper feed, transfer, separation and fixing) and is ejected from the copier within a predetermined time, and is structured to stop the function and to prevent troubles such as fire, in case the transfer sheet is jammed during the course of said steps and is not ejected even after said predetermined time. The arrival of transfer sheet is detected as follows. Upon passing the fixing heater 124 and arrival at the ejecting roller 46, the transfer sheet elevates a jam detecting roller 180 coaxially provided with said ejecting roller, thereby lifting a lever 181 to an upper-left direction and likewise a magnet 130 mounted on the tip of said lever, and a fixed magnetic detecting element 129 releases a signal by said displacement of the magnet 130.

Upon detection of a jam the fixing heater and the main motor M are switched off to terminate the rotation of drum 95, while the original carriage 2 is stopped upon arrival at the home position thereof. The jammed transfer sheet can be easily removed manually by opening a cover 127 together with a duct 128 which is rotatable around a hinge 131 as shown in FIG. 1, as a heating plate 124 is made directly accessible in this state. The separating section including said heating plate 124, being rotatable around an axis 132 and ordinarily maintained in a fixed position by means of a lock 133, can be rotated anticlockwise by disengaging said lock after opening said cover 127 whereby the transfer sheet path after the register roller 41, 42 is made open and allows easy removal of jammed sheet. Removal of sheet jammed in the separating section is also easy as the separating belt 32 becomes retracted from the photosensitive drum 15 in this state.

After the removal of jammed sheet, the original state of the copier can be restored by effecting an operation for releasing the jam-hold state and by closing said cover 127.

Figure 5:
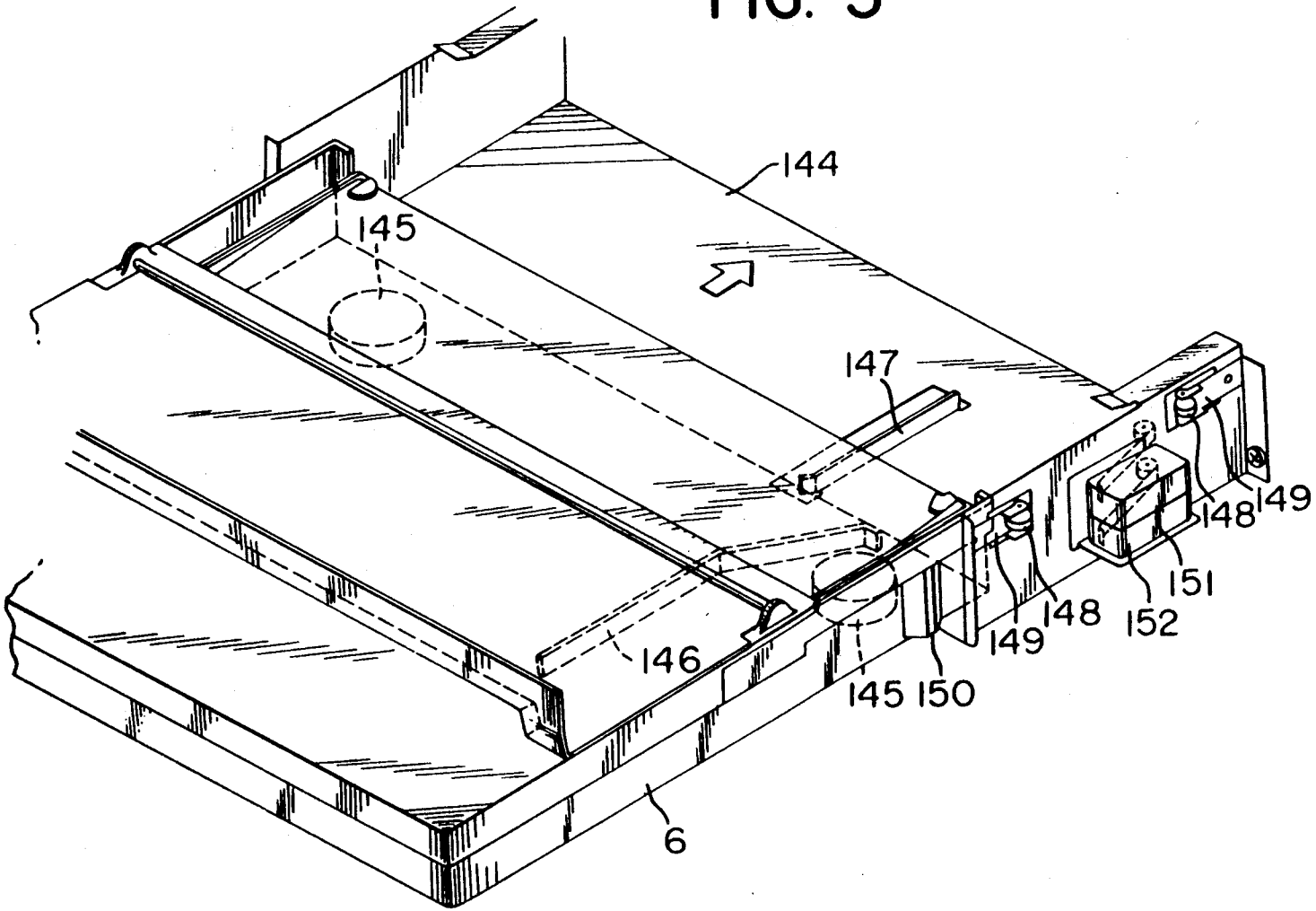
FIG. 5 is a perspective view of a cassette.

Now there will be given an explanation on the mounting of cassette 6 to the main body 1, while referring to FIG. 5. By placing a portion 145 of cassette 6 on a cassette receiving table 144 provided in the main body and inserting the cassette thereinto, a projection 146 provided under the cassette 6 engages with a positioning plate 147 on said table, and the cassette 6 is pressurized to and fixed in a predetermined position by means of a spring 149 provided with a roller 148. In this state a cam 150 provided on a side wall of cassette engages with microswitches 151 (MS1) and 152 (MS2) provided on said table 144 to release a cassette mount signal and a size signal.

Figures 6, 6B:
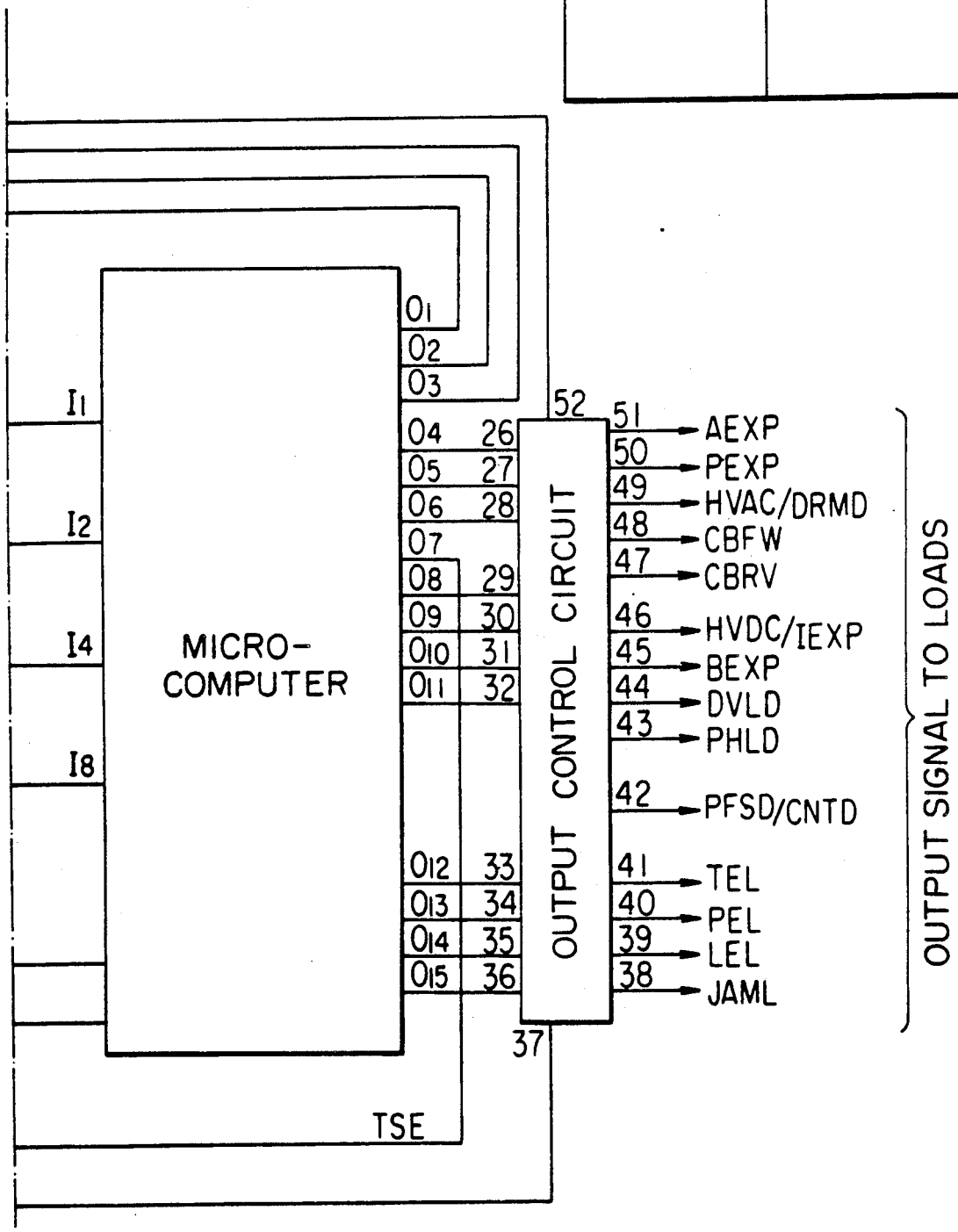
FIG. 6 is a diagram of control circuit.
Figure 6A:
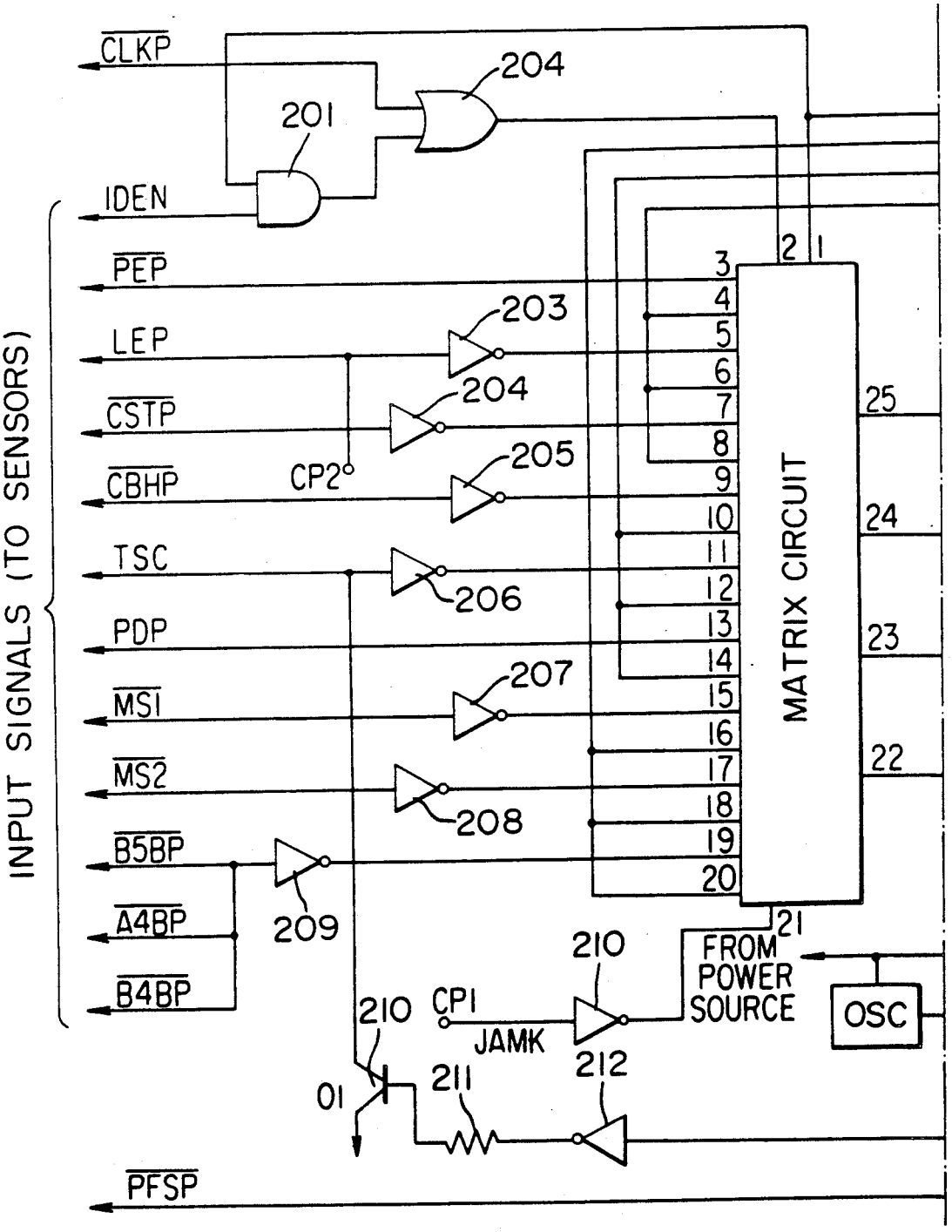

FIG. 6 shows the entire circuit structure for controlling the operable means in the copier, wherein the microcomputer being composed of TMS1000 manufactured by the Texas Instrument Corporation. I1, I2, I4 and I8 are input ports of said computer for receiving the signals from aforementioned magnetic detecting elements and microswitches, while 01 to 015 are output ports for releasing signals for driving pulse transformers, indicating lamps, solenoids, magnetic clutches etc.

Figure 11D:
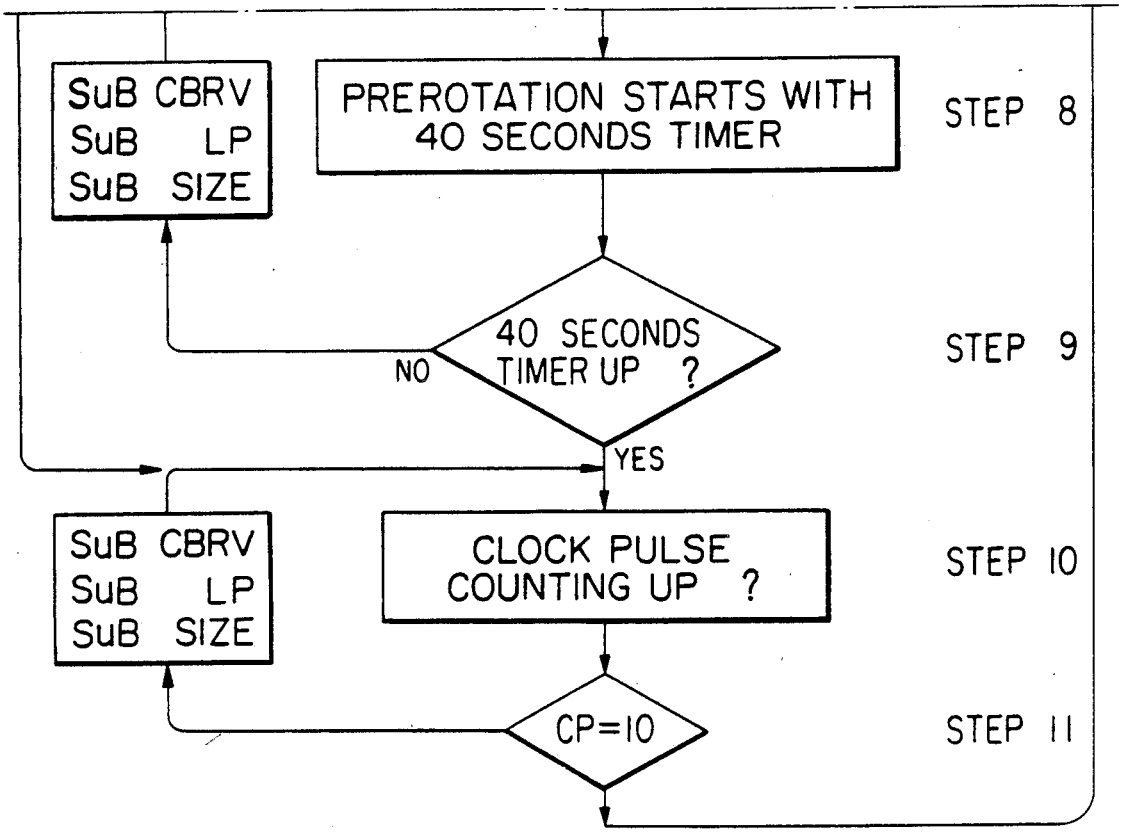
FIGS. 11 and 12 are detailed flow charts corresponding to that shown in FIG. 10.
Figure 11:
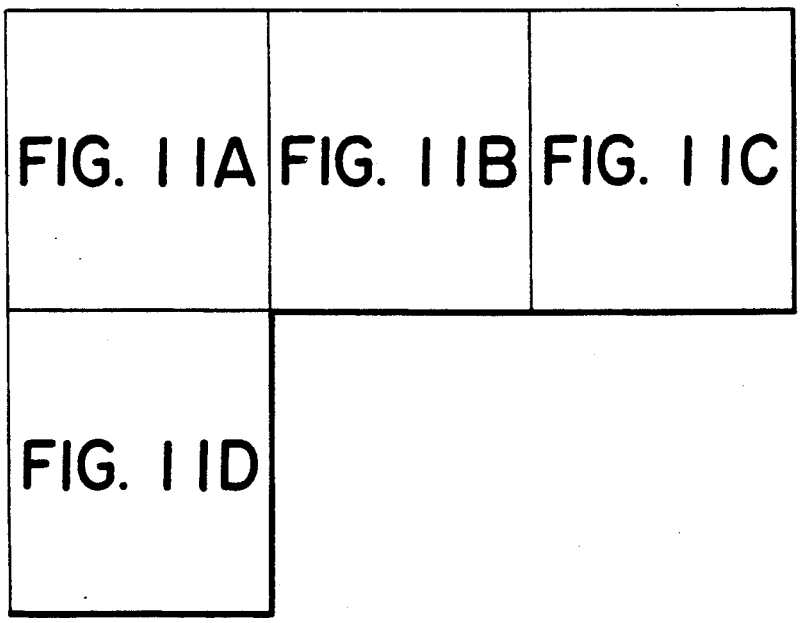
Figure 11A:
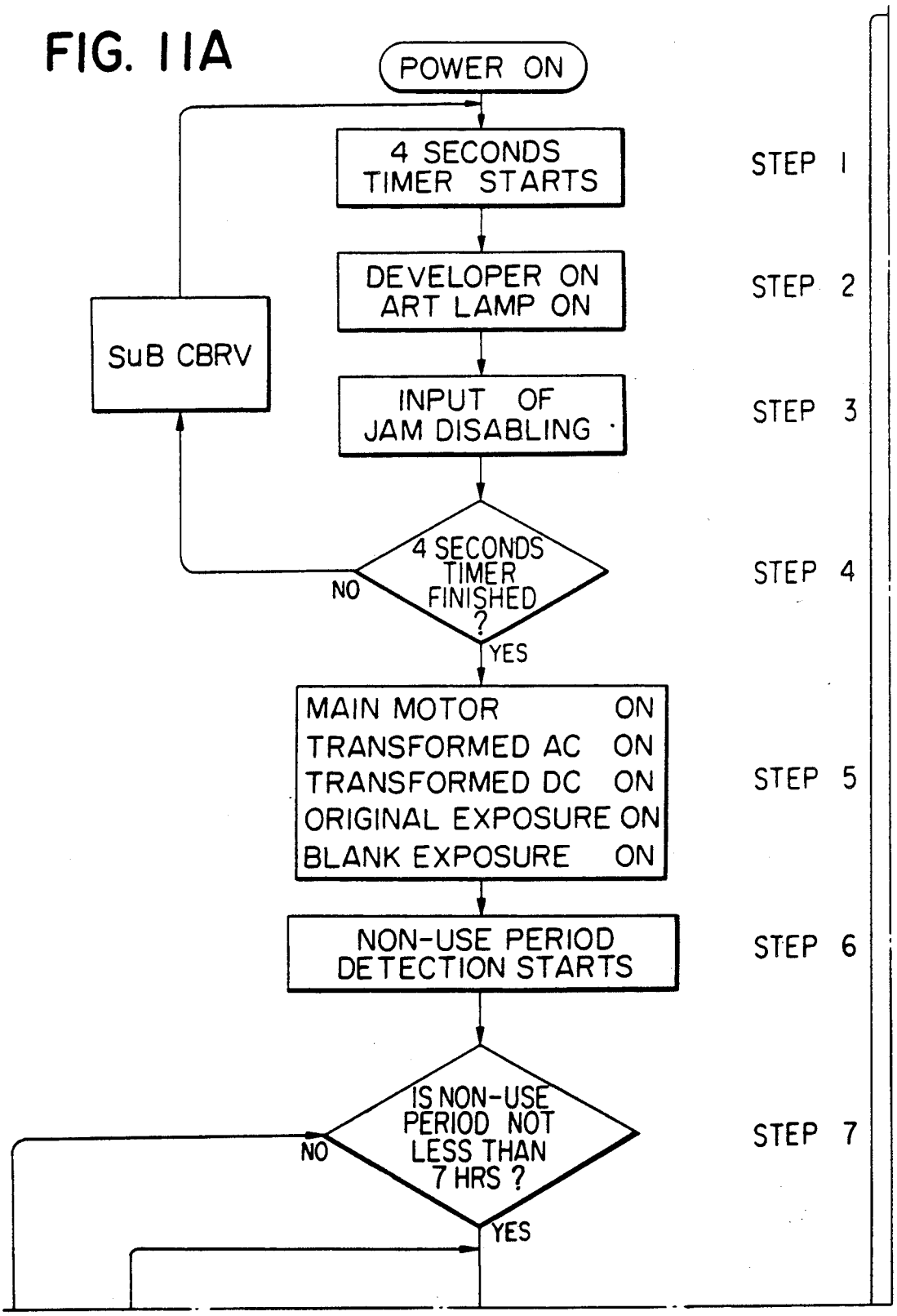
Figure 11C:
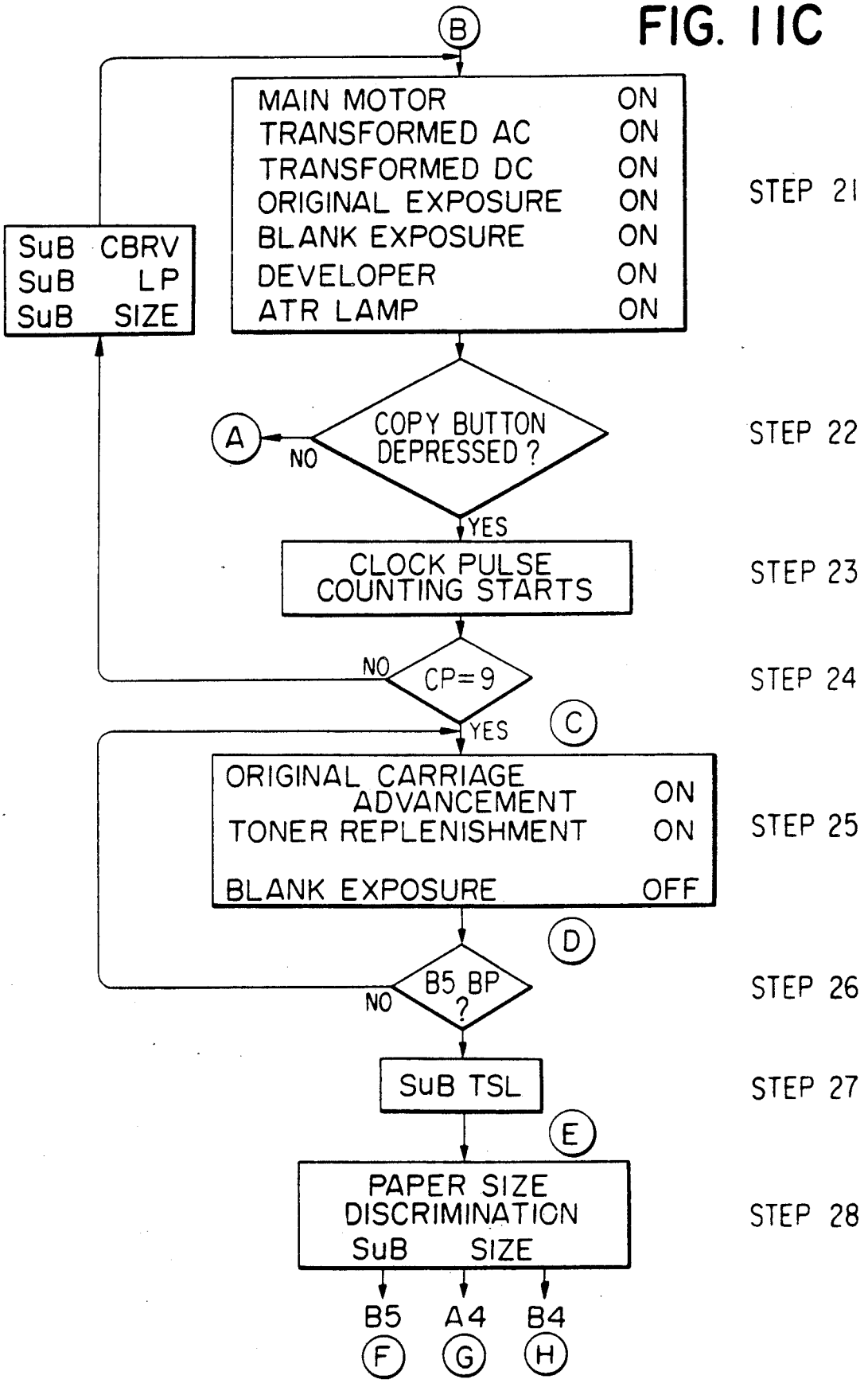
Figure 12G:
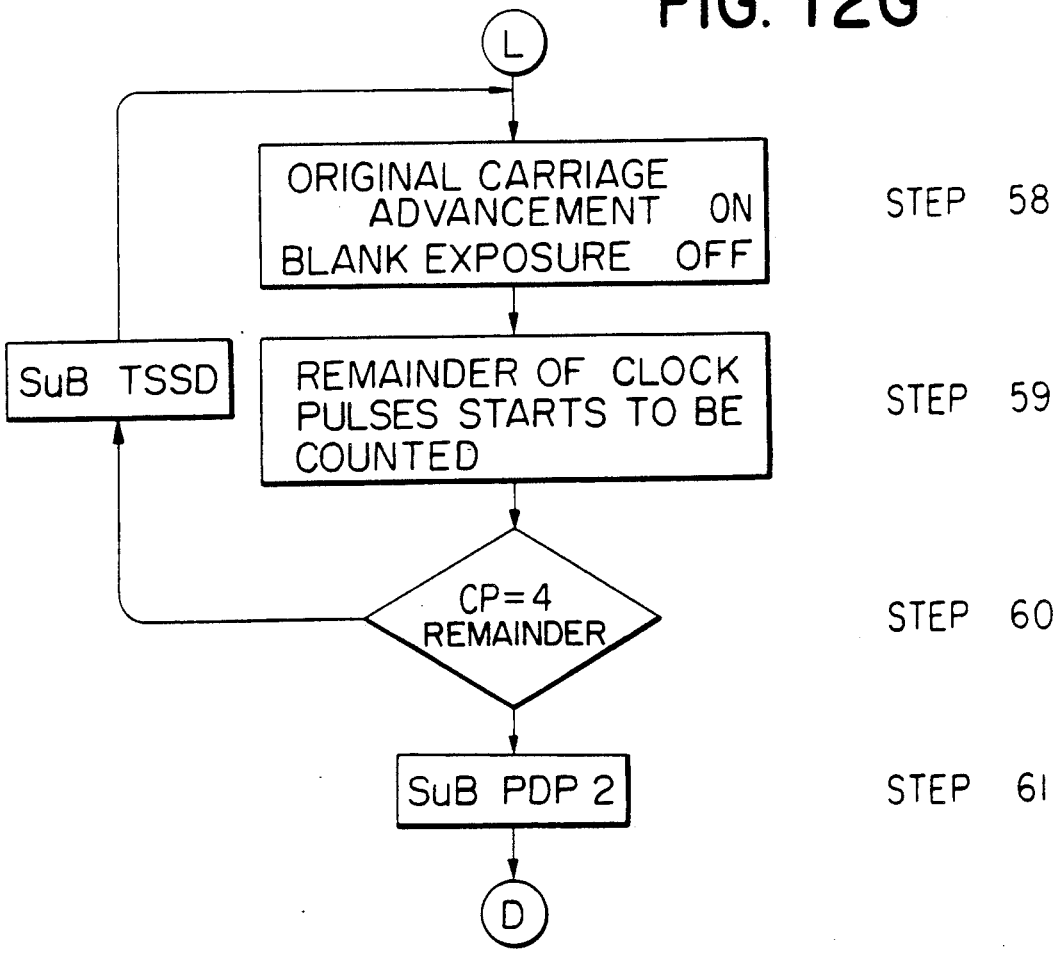
Figure 12:
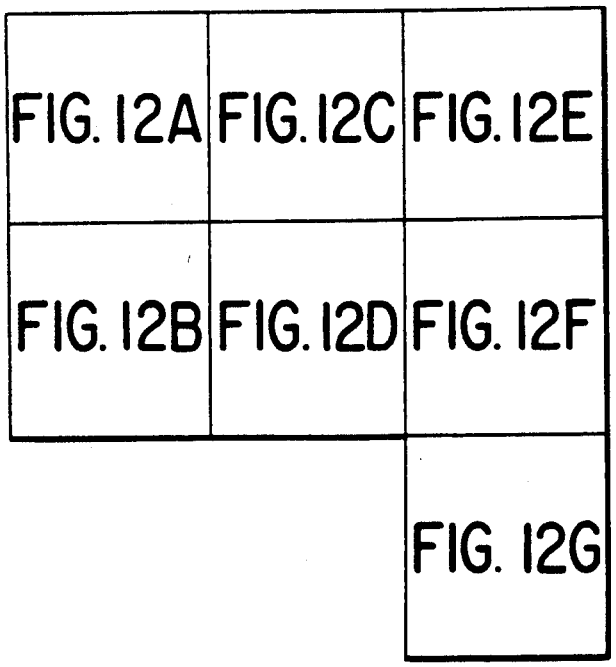
Figure 12A:
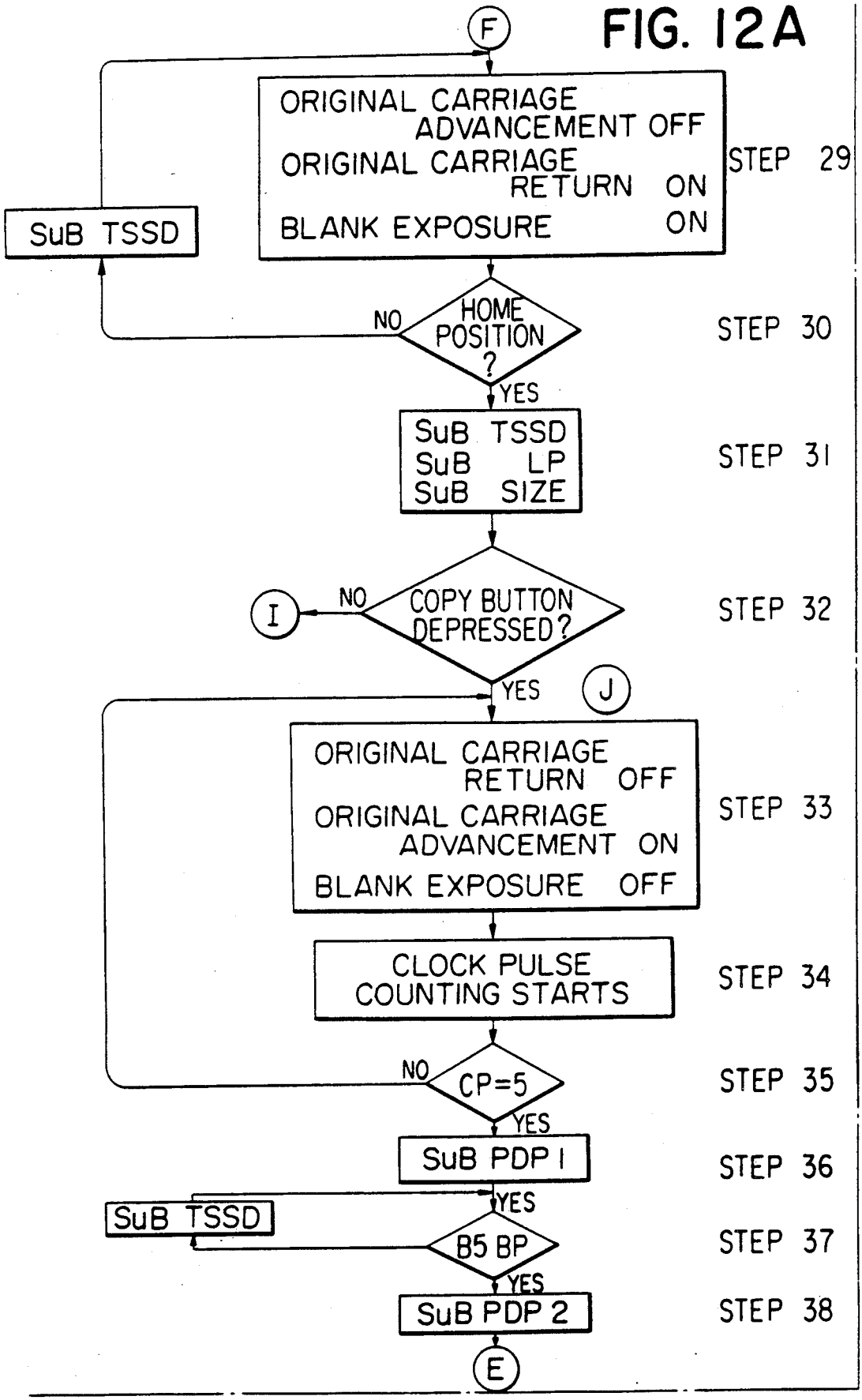
Figure 12B:
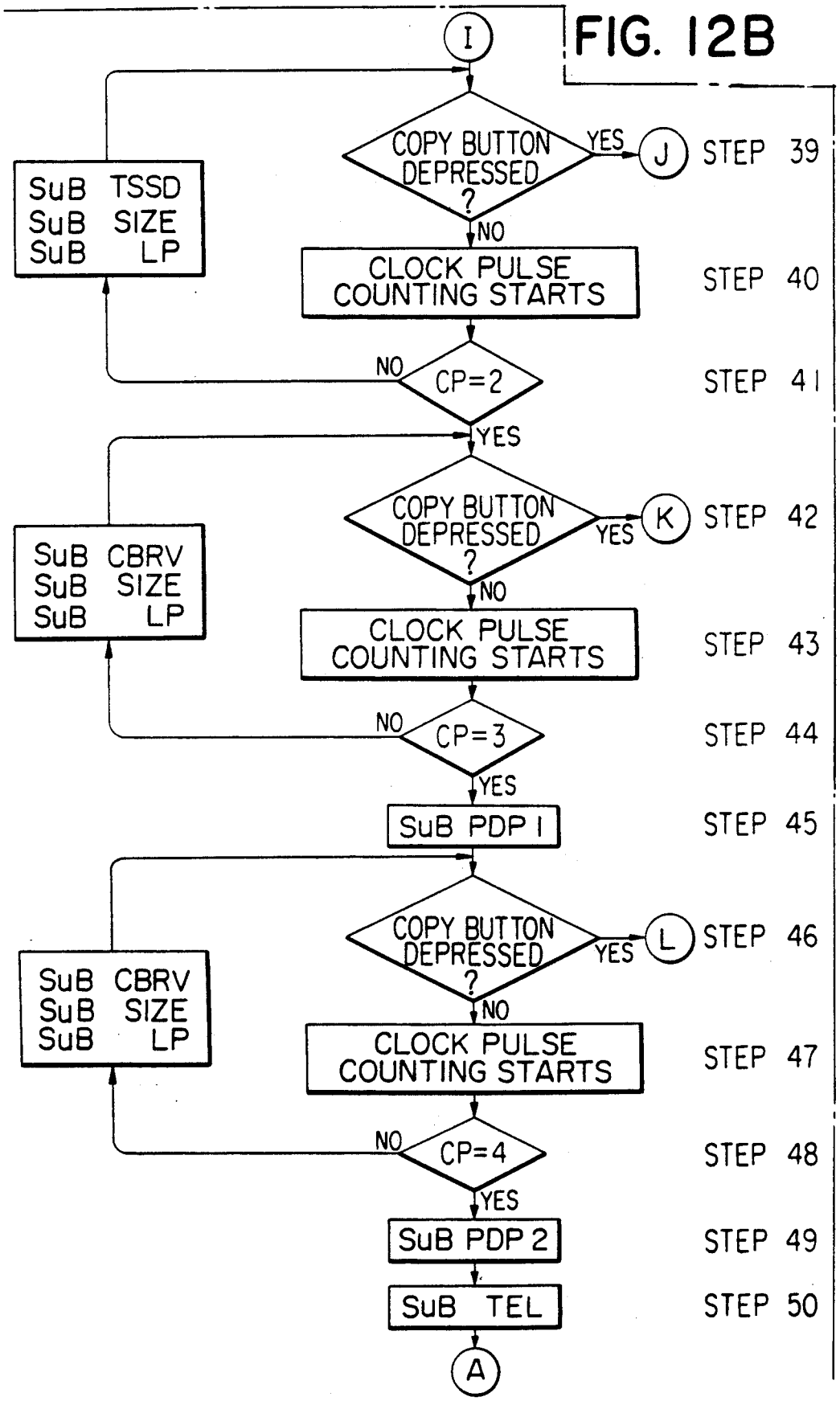
Figure 12D:
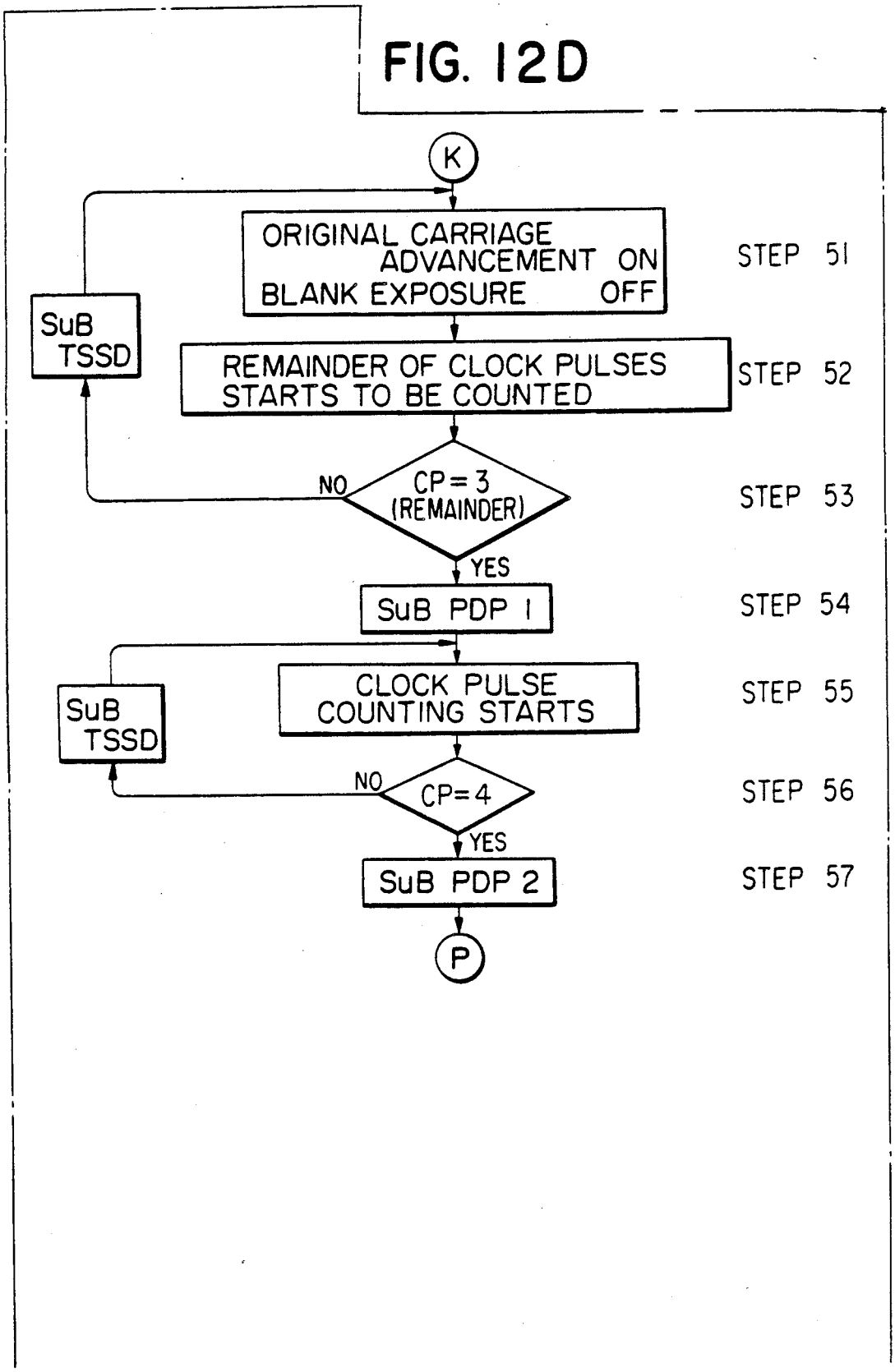
Figure 12E:
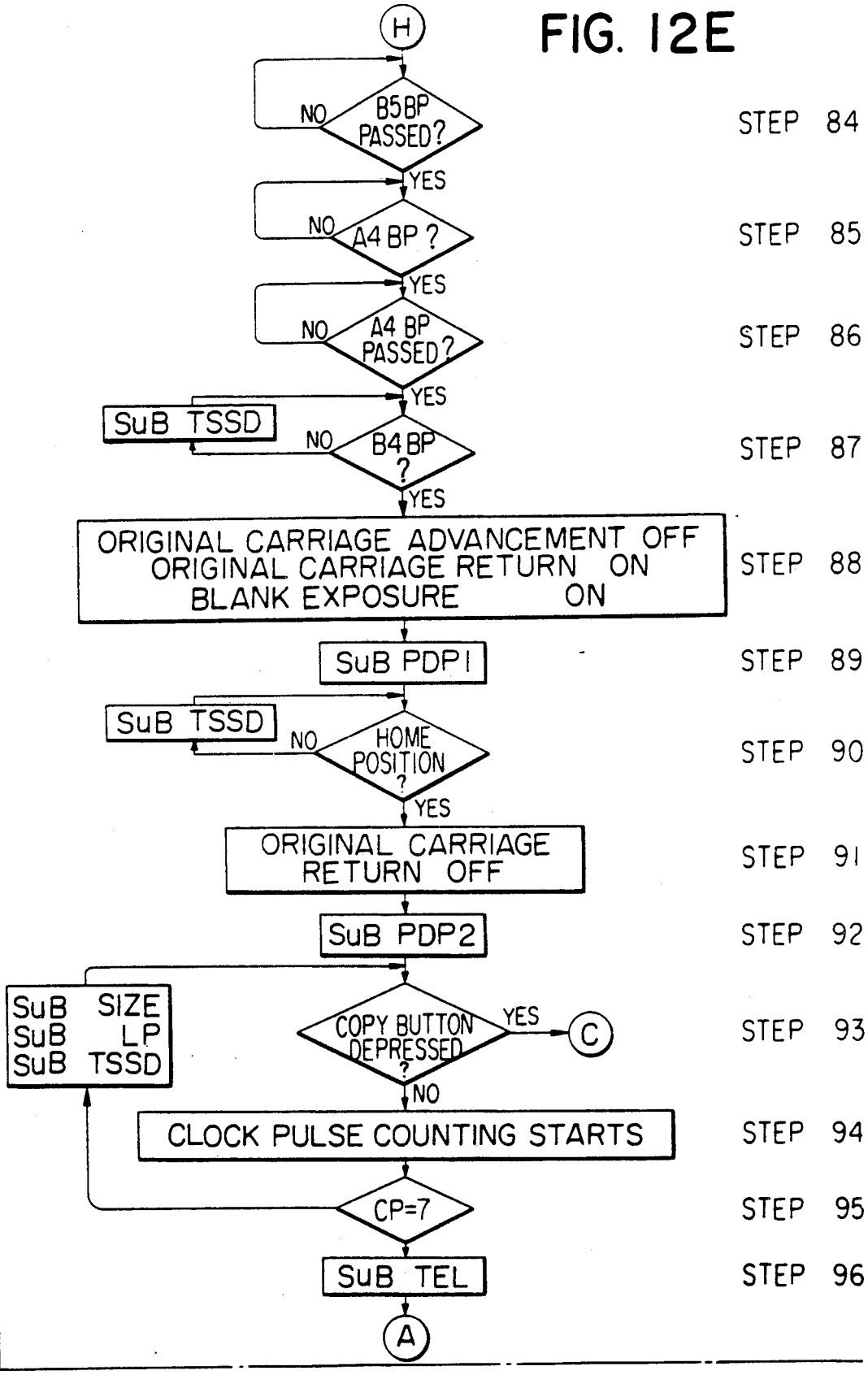
Figure 12F:
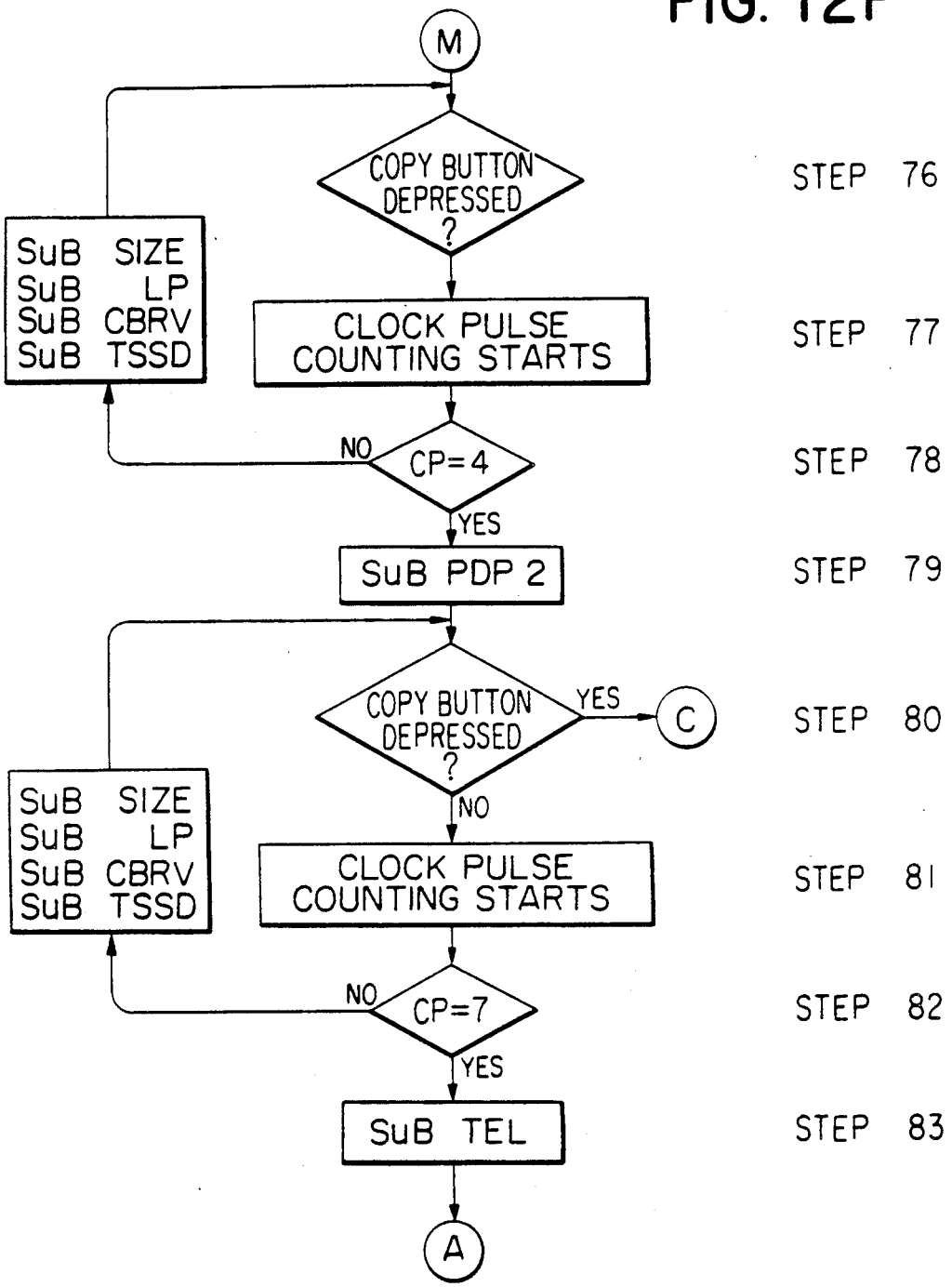

In order to perform time-sequential data processing in the microcomputer of the above-mentioned input signal groups to obtain corresponding timing output or indicating output signals, it is necessary to select a particular input signal from the group of various input signals. For this purpose a part of the output of microcomputer is utilized as a probe signal for selecting the input signal and is supplied to a matrix circuit (FIG. 15), and a signal thus selected is entered into the microcomputer through the input ports I1–I8. The computer processes the information thus entered and release output signals through the ports 01–015 according to the flow charts as shown in FIGS. 11 and 12, said output signals being supplied to an output control circuit (FIG. 16), and, after logic processing, further supplied to drive various operable means including indicators.

Figure 7:
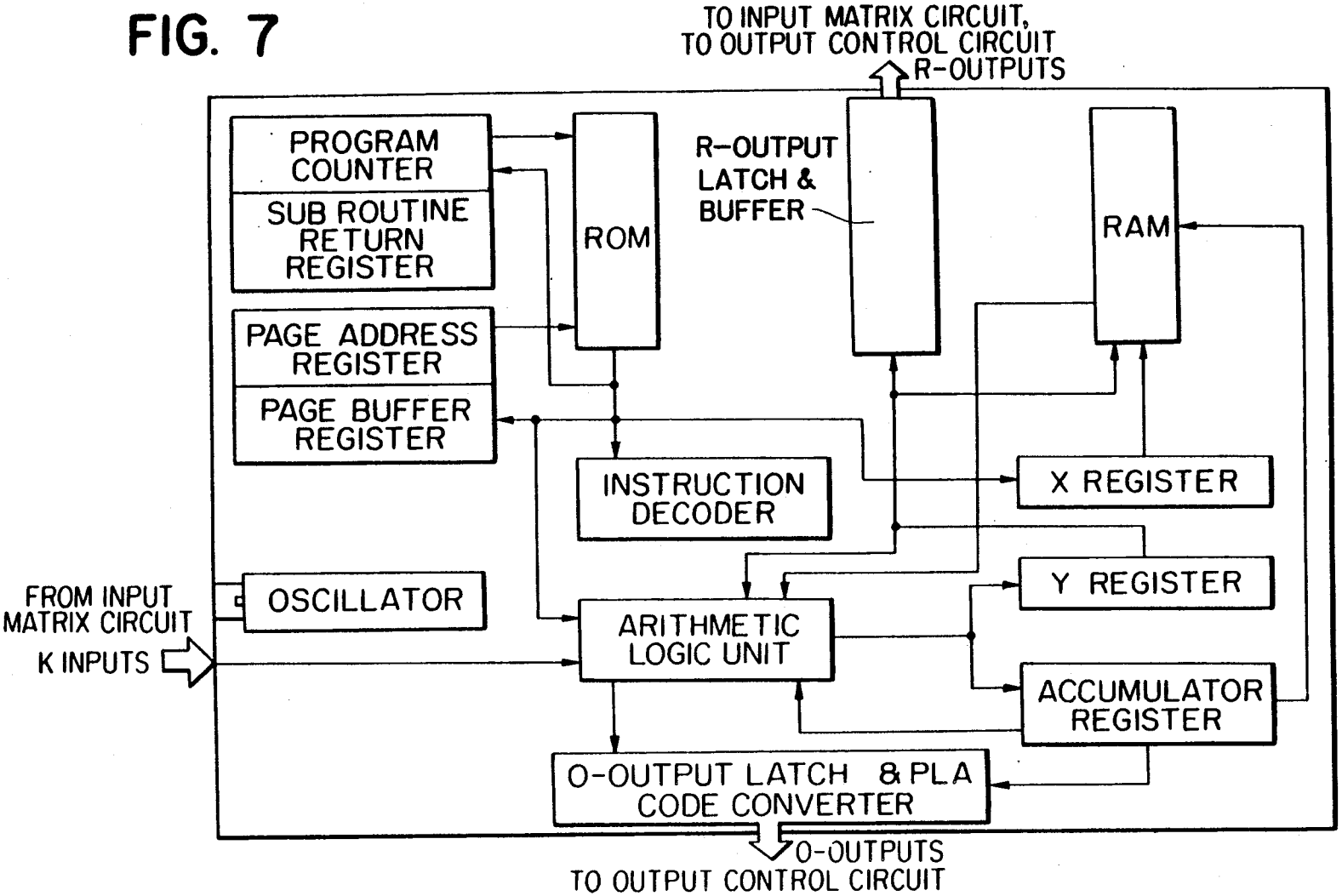
FIG. 7 is a block diagram of a microcomputer.

FIG. 7 shows the internal block diagram of the microcomputer TMS1000 of which internal structure will be briefly explained in the following. ROM is a read-only memory storing the coded contents of sequence program shown in FIGS. 11 and 12 and allowing read-out of said content by addressing. Said contents are stored in 8-bit binary codes from the address 0 to the final address.

Figure 8:
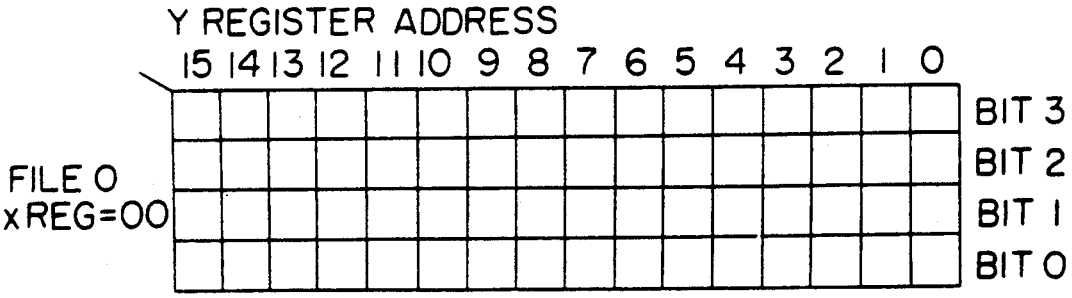
FIG. 8 is an address diagram of a RAM.

RAM is a random accress memory for temporary storage of data, consisting of a set of binary codes, during the execution of the program. FIG. 8 shows the structure of said memory wherein each bit is composed of a flip-flop, and a set of said flip-flops is selected by an address signal to allow write-in or read-out of signal. The address of said RAM is designated by an X register and a Y register. The microcomputer of central processing unit CPU further comprises an arithmetic logic unit ALU for decoding and processing input data, a program counter PC for addressing ROM, a page address register PA for designating a page group of ROM, a page buffer PB for changing the page of ROM, a sub-routine return register SR for requesting a sub-routine and memorizing the return address upon completion of said sub-routine, an instruction decoder ID for decoding the instruction stored in the ROM, and an accumulator AR for temporary storage of the result of processing. The input ports I1, I2, I4 and I8 are connected to K-INPUT while the output ports 01–015 are connected to O-OUTPUT and R-OUTPUT.

Upon turning on of the power supply, the CPU designates an address of ROM storing a program sequence, and the content of the designated address is entered into the CPU through the data line. The CPU decodes the content, and, time-sequentially according to the decoded content, processes the data within the CPU, stores the data in the CPU into a designated address of RAM, reads the data of a designated address of RAM, supplies the data to the output lines or reads the data from input lines thereby performing a sequence control.

Figure 9:
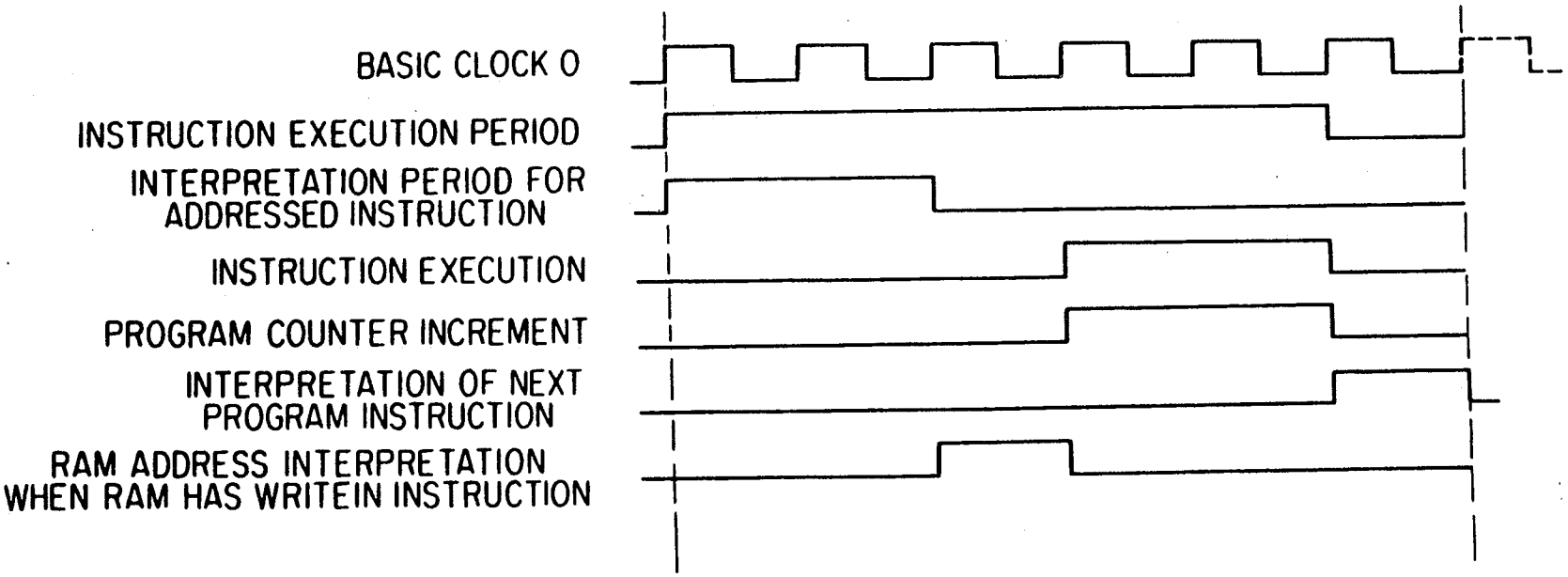
FIG. 9 is a basic time chart of microcomputer.

FIG. 9 shows the basic timing chart of the program execution by TMS1000, which is based on basic clock pulses $\phi$ of several microseconds received from an oscillator OSC shown in FIG. 7. An instruction is executed by 6 clock pulses, in which 2 pulses are required for decoding of program counter, 2 pulses are required for addressing of ROM according to said decoding and for simultaneous step advancing of program counter PC, 1 pulse for decoding a program instruction of ROM and 1 pulse for writing in the RAM.

Figure 15:
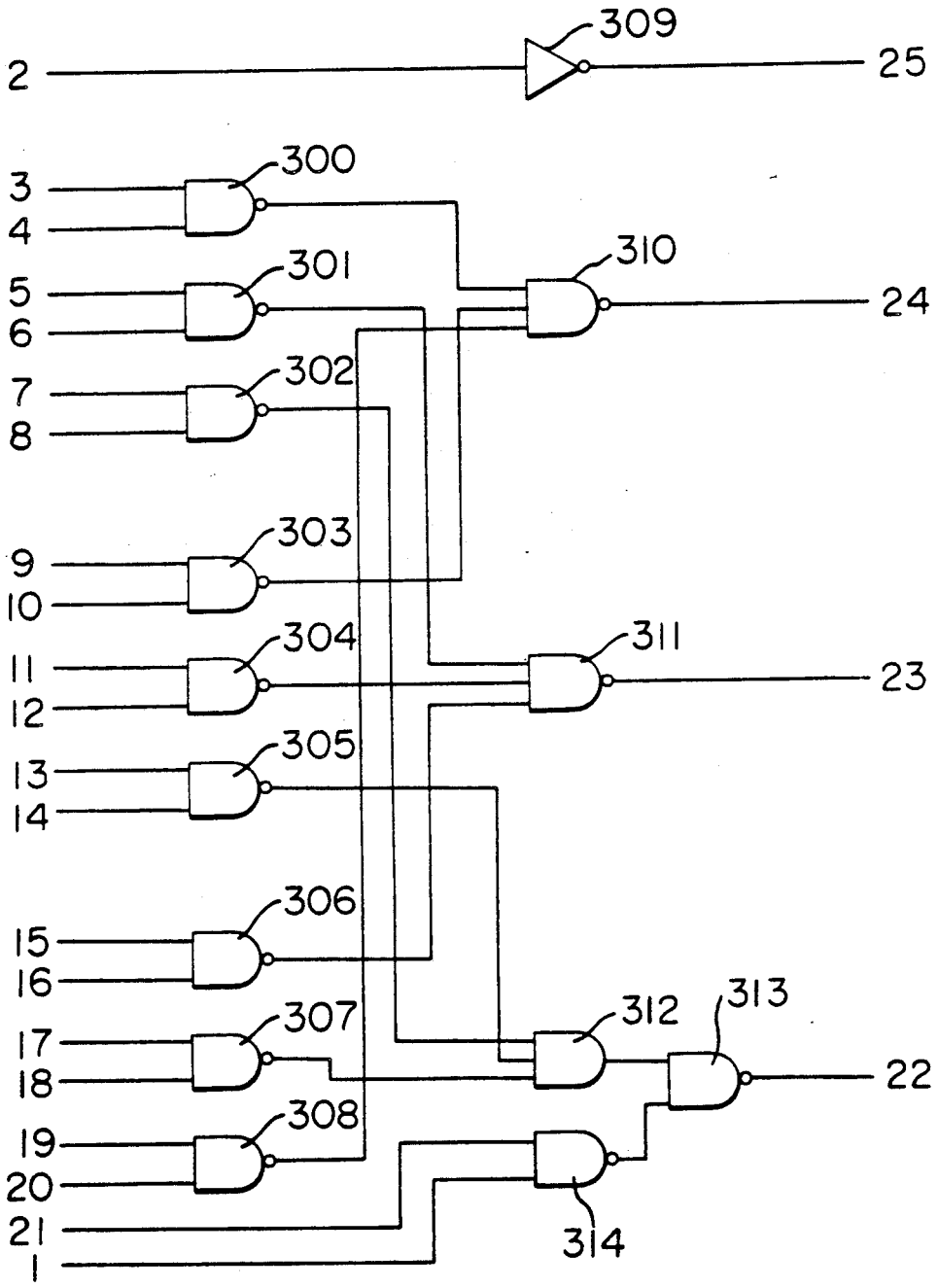
FIG. 15 is a diagram of an input matrix circuit.

As an interface between the input ports of four bits and the input signals of a larger number from the copier, there is provided a matrix circuit shown in FIG. 15. The relationship between the probe terminal $\theta 1$–$\theta 3$ and the input ports I1–I8 is summarized in the following Tab. 1;

TABLE 1

| Probe | Input I2 | I4 | I8 |
|---|---|---|---|
| 01 | PEP | LEP | CSTP |
| 02 | CBHP | TSC | PDP |
| 03 | B5BP<br>A4BP<br>B4BP | MS1 | MS2 |
| PURS | — | — | JAMK |

wherein CLKP stands for clock pulse generated in synchronization with the photosensitive element, PEP for a signal for no paper, LEP for a signal for no liquid, CSTP for the copy start button, CBKP for a signal indicating the carriage at the home position, TSC for a toner supply signal, PDP for a paper detection signal, B5BP, A4BP and B4BP for carriage reverse signals for various paper sizes, MS1 and MS2 for cassette microswitches for detecting paper sizes, and JAMK for a signal indicating that jam detection is impossible.

Also the input port I1 is used for the input of the drum clock pulse CLKP and a signal for the stand-by time IDEN to be explained later.

The input signals change from time to time, and the computer releases a probe signal $\theta 1$, $\theta 2$, or $\theta 3$ (not more than one probe signal being released at a time) at a desired time to read the selected input signal through 4 bits (I1, I2, I4 and I8 in parallel) and identifies the 1 or 0 state of each bit. By time-sequentially repeating this operation it is rendered possible to identify the state of input signals changing from time to time.

FIG. 15 shows an input matrix circuit wherein 300–308, 310, 311, 313 and 314 are NAND gates, 309 is an inverter, and 312 is an OR gate, the terminals in the circuit corresponding to those in FIG. 6.

Figure 23A:
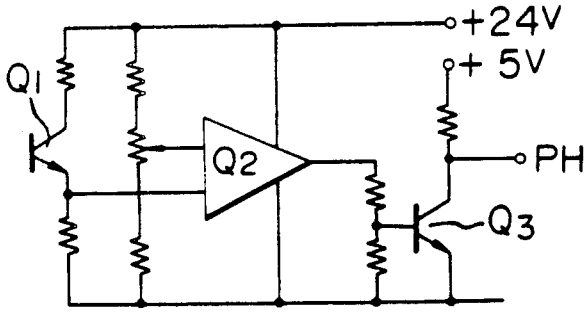
FIGS. 23A, 23B and 23C are diagrams of examples of the input sensor shown in FIG. 6.

Now there will be given an explanation on an example of data input and functioning the indicator lamp for no paper when the papers in the cassette are exhausted. Said signal for no paper is obtained by a combination of a lamp and a photo-detector provided in the vicinity of the cassette. When the papers are exhausted, the resistance of said photo-detector is reduced and a corresponding detecting circuit, for example that shown in FIG. 23A releases a signal for no paper (PEP=1). Thus the input 3' of NAND gate 300 in the matrix circuit is changed to 0 level, while the input 4' of said NAND gate 300 receives the probe signal $\theta 1$ from the microcomputer shown in FIG. 6. Thus the PEP signal is read from the input port I2. The write-in of other input signals is performed according to Tab. 1. In FIG. 23A the resistance of a phototransistor Q1 is lowered to start the function of an operational amplifier Q2, thereby causing the transistor Q3 to release a signal.

In the control flow, the read-in of no-paper signal etc., is executed in the STEP 8, SUB LP shown in FIG. 11. When the program proceeds to said STEP 8, the signal $\theta 1$ is set to level 1 each time the program passes the SUB LP and returns to level 0 as soon as the completion of signal reading. The period from signal $\theta 1$ setting to the completion of signal reading is ca. 60 microseconds.

During said signal $\theta 1$ setting, other probe signals $\theta 2$ and $\theta 3$ are maintained at level 0. When the probe signal $\theta 1$ is at level 1, the input 4' of NAND 300 in FIG. 15 is placed at level 0 to obtain a level 1 output from said NAND gate 300, while the NAND gate 308 provides a level 0 output since other inputs thereof, or the outputs of gates 303 and 307, are at level 1 because of the non-set state of the probe signals $\theta 2$ and $\theta 3$.

Figure 16:
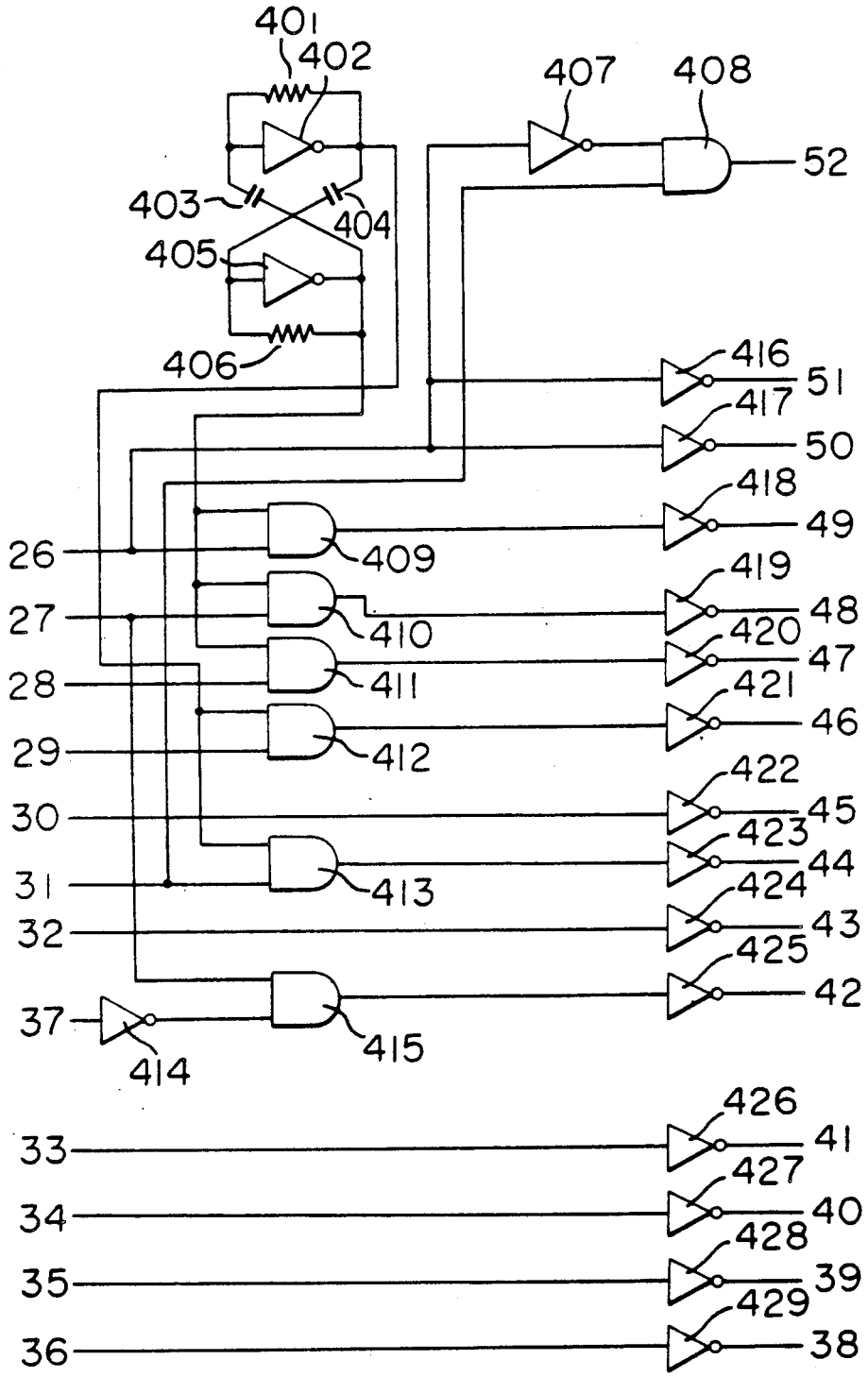
FIG. 16 is a diagram of an output control circuit.

The output line 24' of said gate 308 is connected to the microcomputer shown in FIG. 6, and read by the program step SUB LP, the data thus read being stored in the 0 address, bit 1 (hereinafter represented as (0, 1) of Y register of RAM shown in FIG. 8. The step SUB LP identifies if the bit 1 is 0 or 1, and, if 0, supplies a level 1 signal for no paper to the port 013 shown in FIG. 6. Referring to FIG. 16 and upon receipt of a level 1 signal to the terminal 34', a buffer inverter 427 releases a level 0 output to function the lamp for no paper.

In case the cassette contains paper, the gate 300 shown in FIG. 15 receives a level 1 signal at the input 3' thereof to release, when the probe signal $\theta 1$ is at level 1, a level 0 output, whereas the gate 308 providing a level 1 output, thereby storing a level 1 signal in the bit 1 of RAM.

In this case the signal for no paper is not released since the bit 1 at level 1 indicates the presence of paper.

Other input signals are similarly read in corresponding program steps. In the matrix circuit shown in FIG. 15, the logic gate 310 provides an OR output of PEP, CBHP and BP, the gate 311 provides an OR output of LEP, TSC and MS1, and gate 313 provides an OR output of CSTP, PDP, MS2 and JAMK to the microcomputer.

The present embodiment of the matrix circuit is featured in that the carriage reverse signals for the sizes B5, A4 and B4 are supplied to an OR circuit whereby the matrix releases a single reverse position signal. This is based on a fact that the carriage reverse signals for different paper sizes are not supplied at the same time, and the reverse signal is identified according to the paper size memorized in the RAM by the size sub-routine. Such arrangement is advantageous in that the number of probe signals can be limited to three.

Figure 23B:
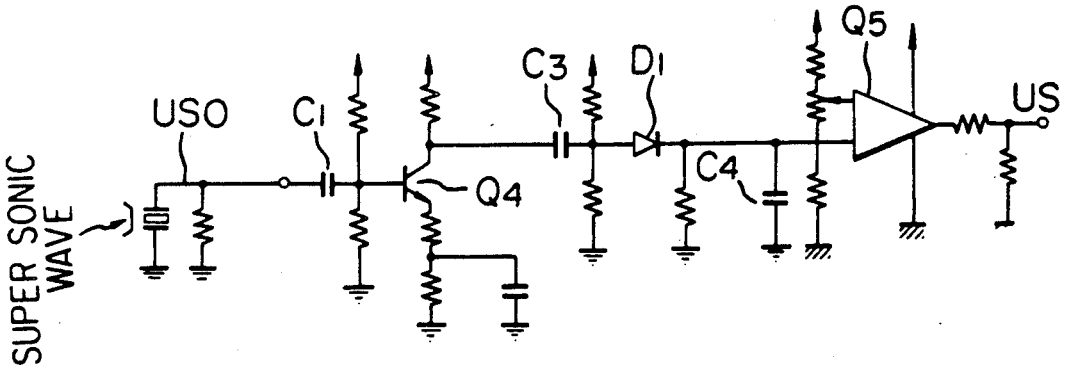
Figure 23C:
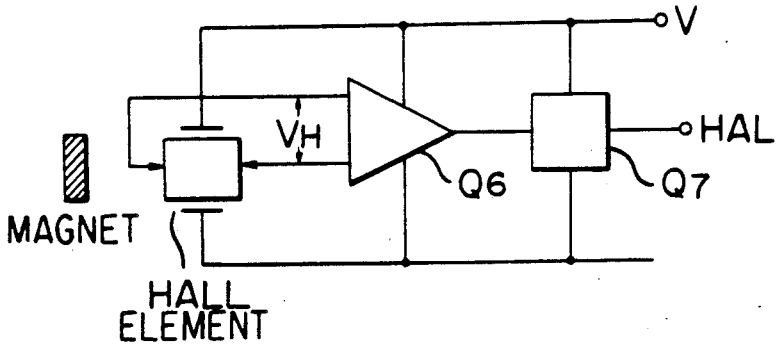

FIG. 23C shows an example of a detection circuit utilizing a Hall element which, by approach of a magnet, operates an operational amplifier Q6 to release a detection signal HAL from a drive circuit Q7. FIG. 23B shows a circuit for paper detection etc. by means of an untrasonic oscillator USO instead of the Hall element, wherein an AC signal supplied through a condenser C1 is amplifier Q4 to operate an operational amplifier Q5 thereby releasing a detection signal US.

In the following there will given an explanation on the output circuit shown in FIG. 16 wherein the terminal numbers correspond to those in FIG. 6.

In FIG. 16 there is provided a 5 kHz oscillator composed of inverters 402, 405, resistors 401, 406, and condenser 403, 404 for driving a triac (not shown) through a triggering pulse transformer, said triac being utilized for driving AC loads such as main motor. Also the AND gates 409, 410, 411, 412 and 413 function as loads of said pulse transformer.

The output 52 is utilized as a 4-second timer functioning after the turning on of main switch. 76' is a main motor signal. Said signal remains at level 0 for 4 seconds after the power on and remains at level 1 thereafter. Thus an inverter 407 releases a level 1 output for 4 seconds, while the other input 31' of the AND gate 408 is a developing motor signal which remain at level 1 from the power on to the start of post-treatment, so that the AND signal obtained therefrom remains at level 1 for 4 seconds after the power on.

The terminal 37 receives a paper feed signal from the detecting element 71 before the original carriage reaches the reversing position for the size B5 and releases a level 0 signal upon receipt of said paper feed signal. On the other hand the terminal 27 is maintained at level 1 during the forward displacement of original carriage. Thus the AND gate 415 releases a paper feed signal only during the forwarddisplacement of original carriage. Thus the AND gate 415 releases a paper feed signal only during the forward displacement of the original carriage but not during the reversing displacement since the terminal is at level 0 though the terminal at a same signal level as in the forward displacement.

Inverters 416–429 are Darlington transistors for driving various loads when the inputs thereto are in level 1, said loads being summarized in Table 2.

TABLE 2

| | |
|---|---|
| Inverter 416 | to the whole-surface exposure lamp AEXP; |
| Inverter 417 | to the preexposure lamp PEXP; |
| Inverter 418 | to the AC charger HVAC and main motor DRMD; |
| Inverter 419 | to the original carriage advancing motor CBFW; |
| Inverter 420 | to the original carriage reversing motor CBRV; |
| Inverter 421 | to the positive primary charger, negative charger, positive transfer charger HVDC and original exposure lamp IEXP; |
| Inverter 422 | to the blank exposure lamp BEXP; |
| Inverter 423 | to the developing motor DVLD; |
| Inverter 424 | to the power hold relay PHLD; |
| Inverter 425 | to the paper feed clutch and paper feed counter PFSD/CNTD; |
| Inverter 426 | to the lamp for no toner TEL; |
| Inverter 427 | to the lamp for no paper PEL; |
| Inverter 428 | to the lamp for no liquid LEL; and |
| Inverter 429 | to the jam indicator lamp LAML. |

Figure 13A:
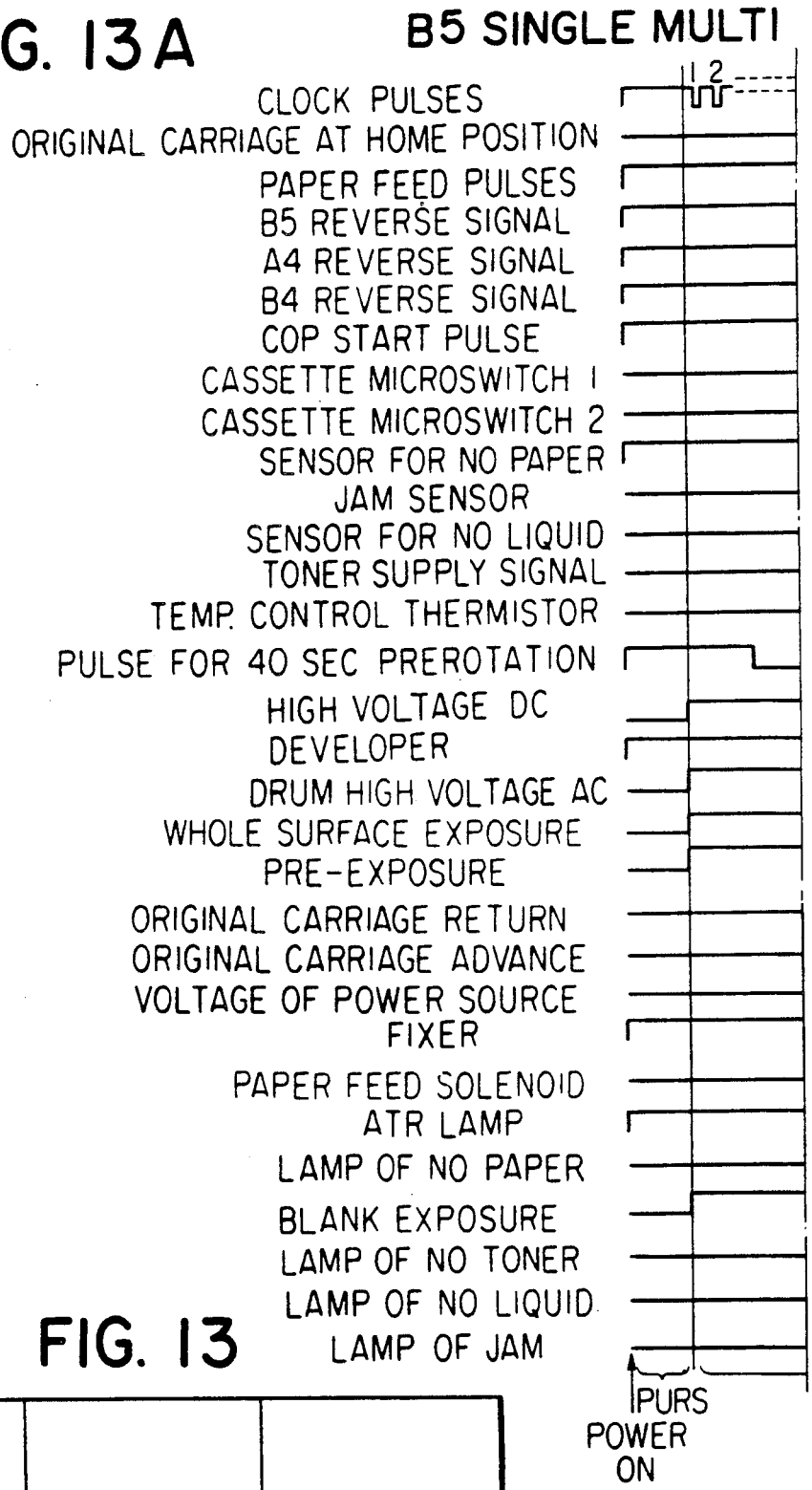
FIG. 13 is an operation timing chart for a B5 size.
Figure 13:
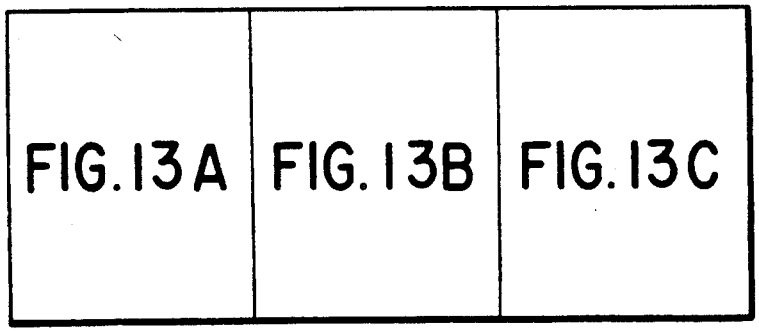
Figure 13B:
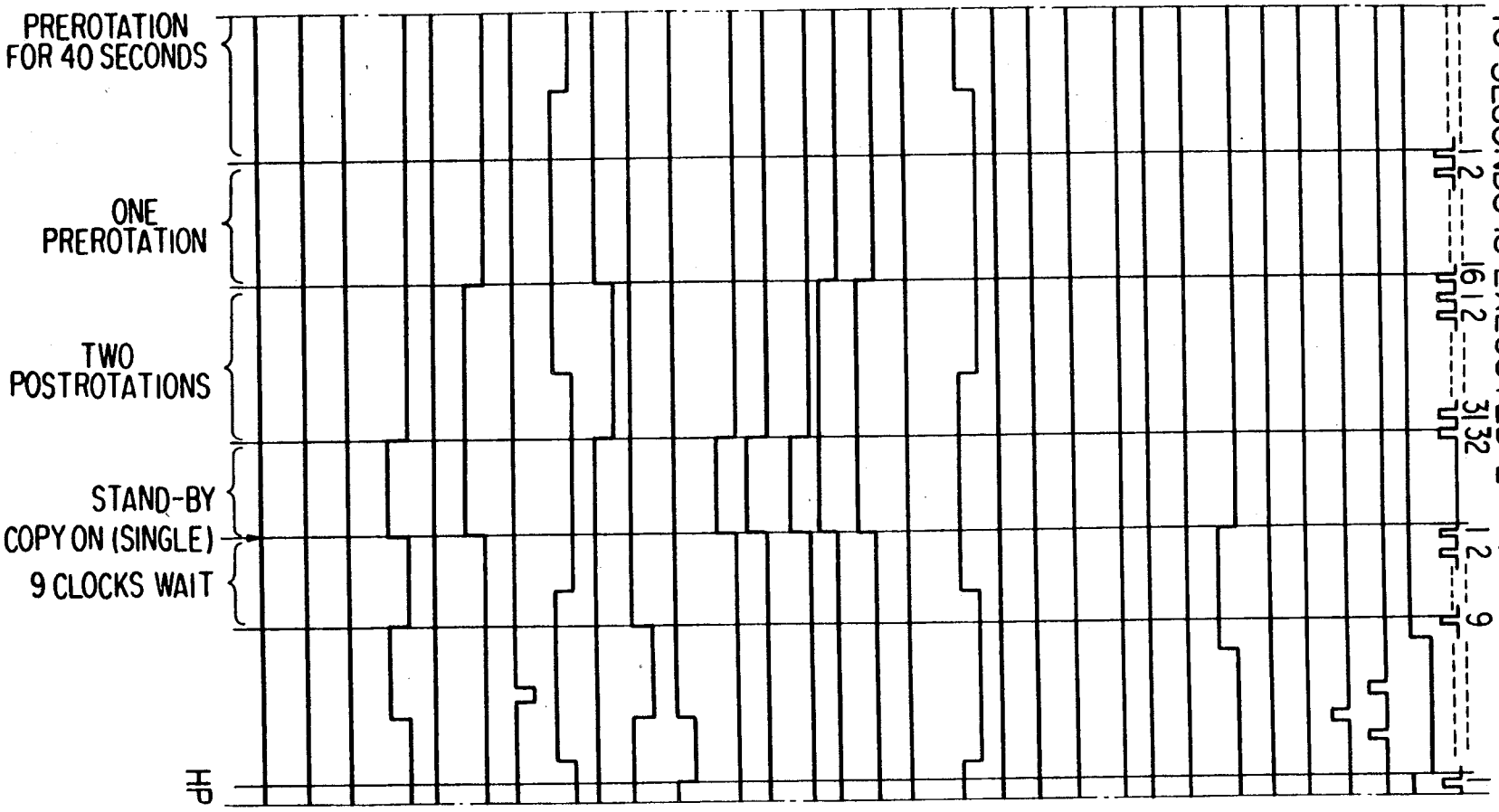
Figure 13C:
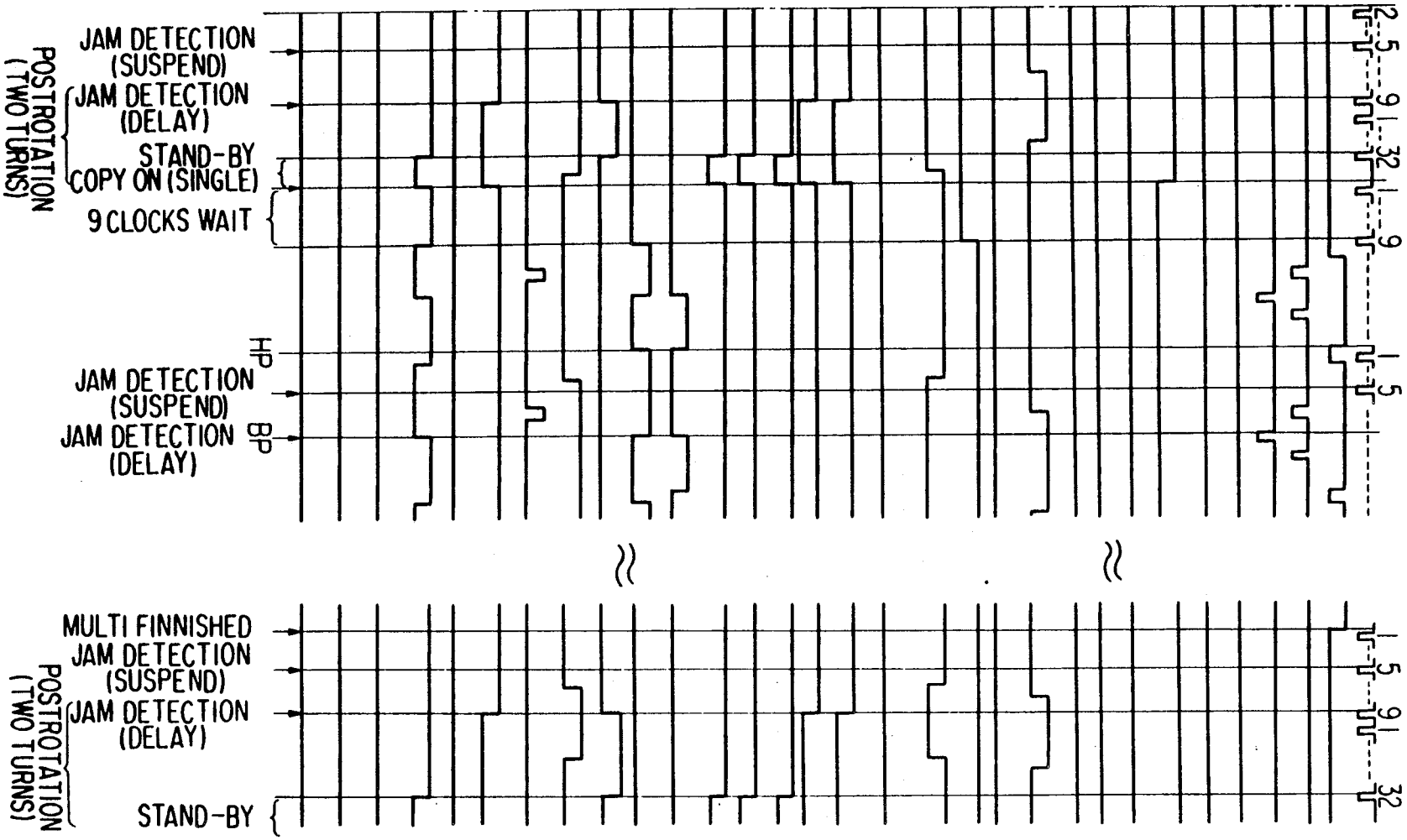
Figures 14, 14A:
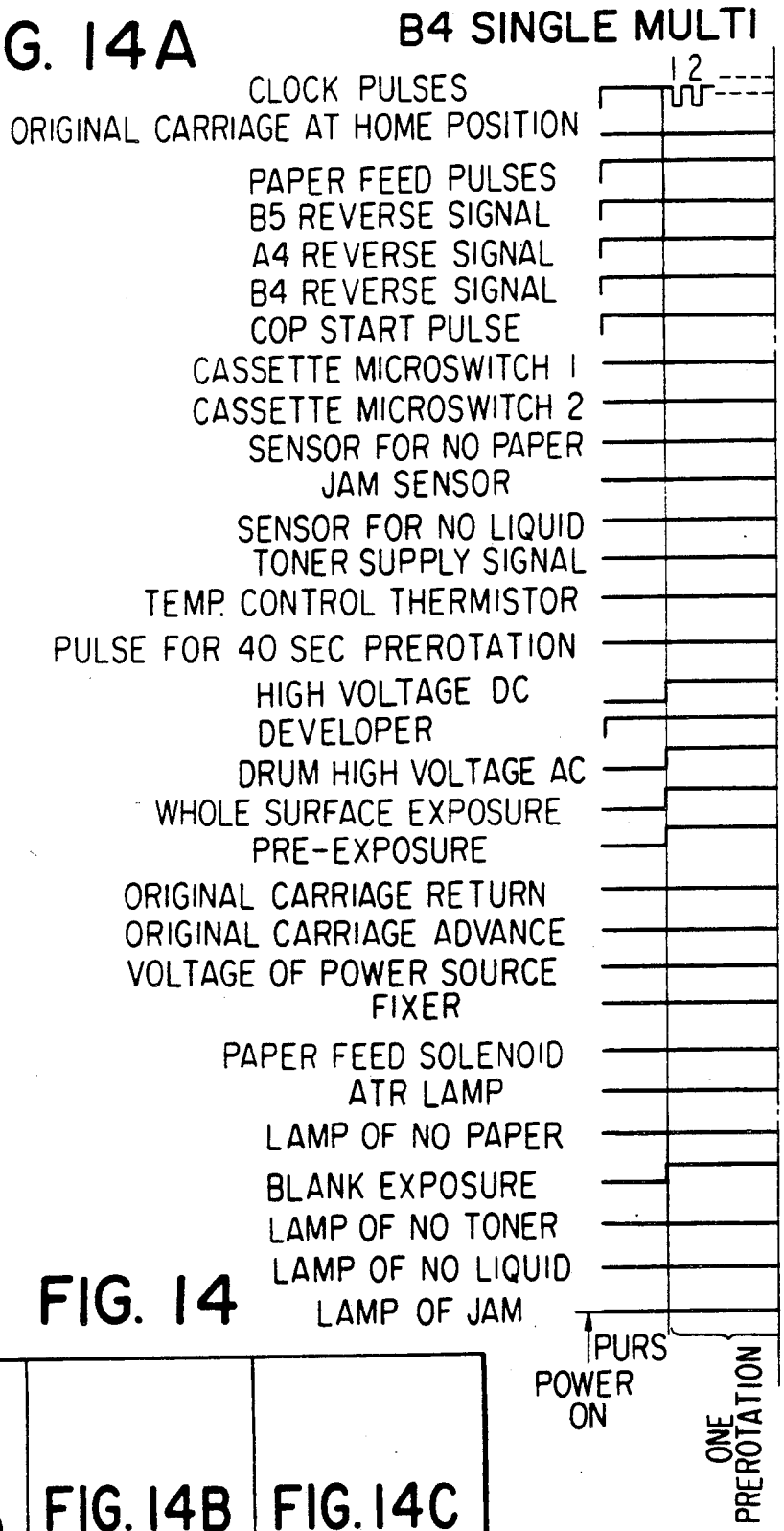
FIG. 14 is an operation timing chart for a B4 size.
Figure 14B:
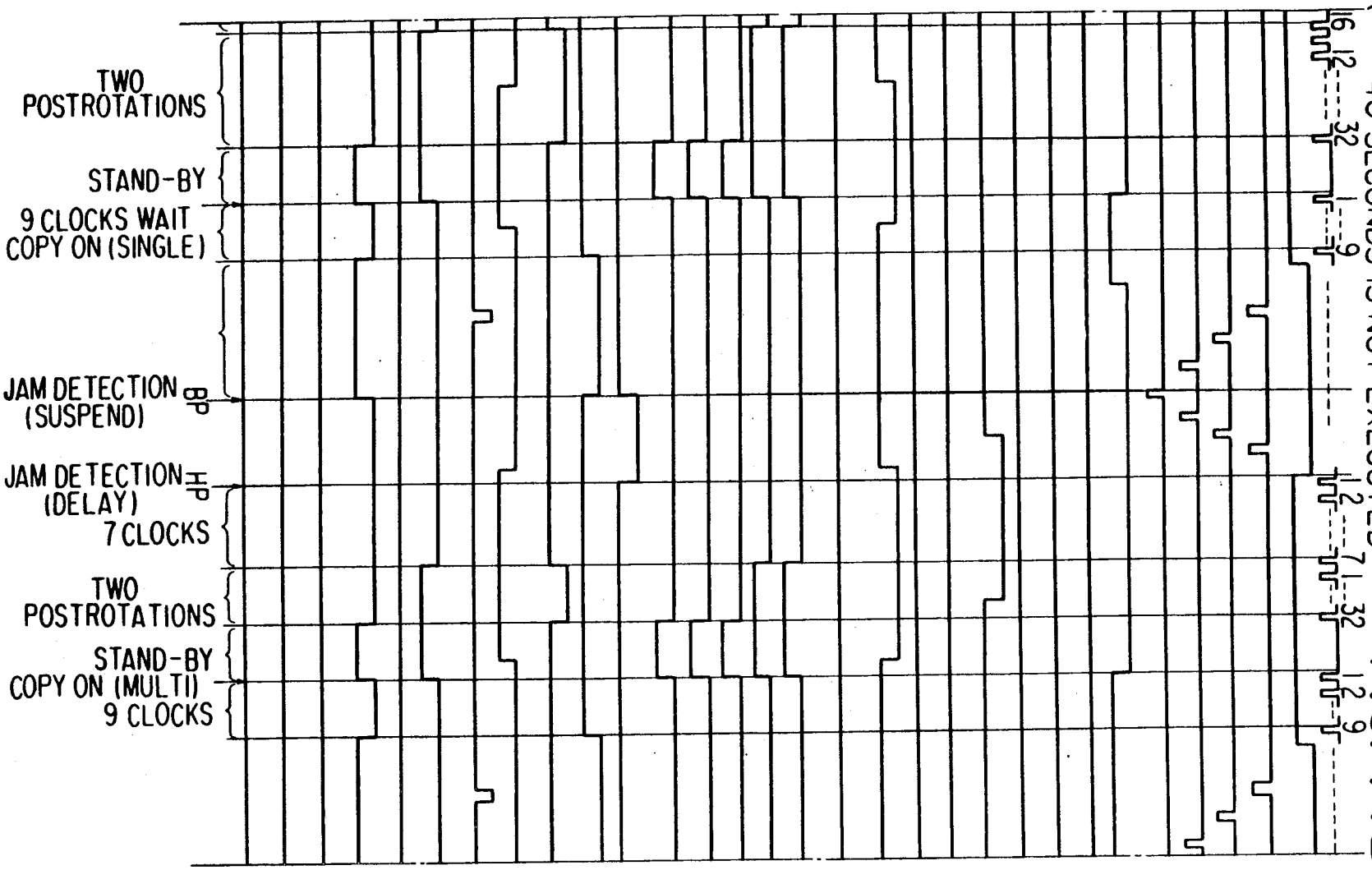
Figure 14C:
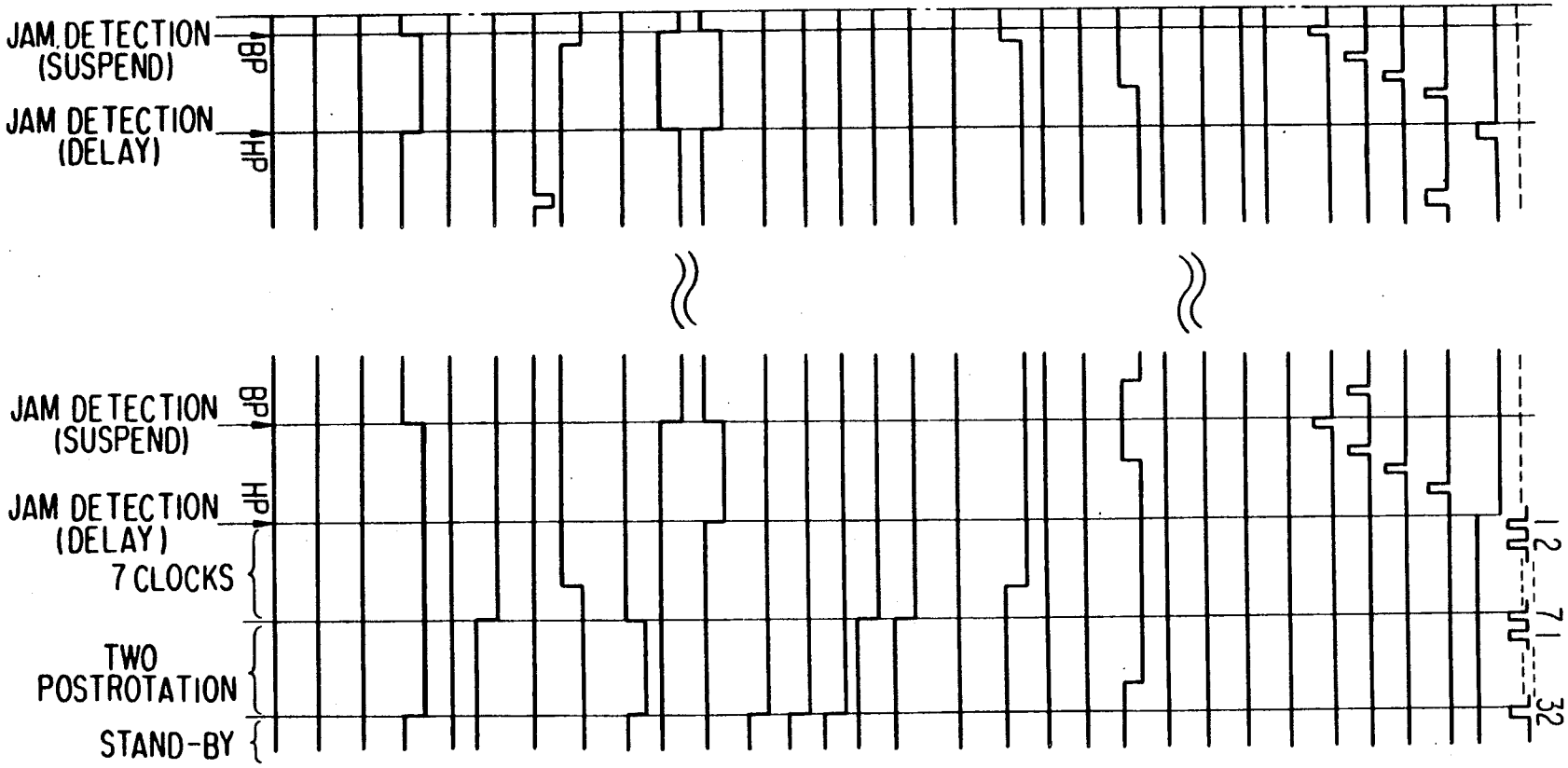
Figure 26:
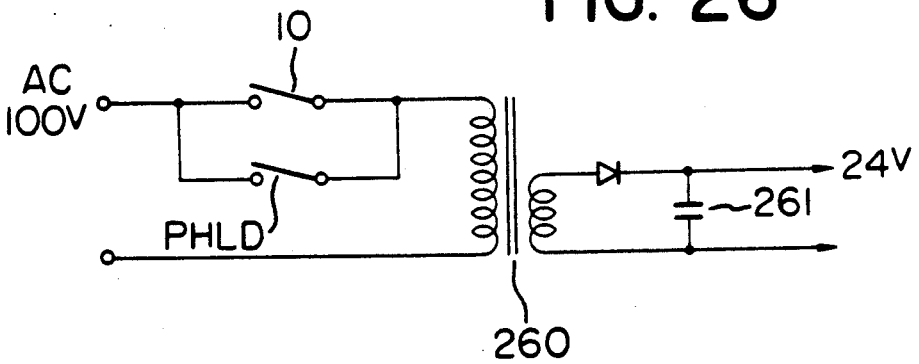
FIG. 26 is an input power supply circuit for use in the circuit shown in FIG. 22.

The paper feed clutch PFSD lowers the paper feed roller 40 constantly rotated after the main switch is turned on to bring into contact with the paper by the above-mentioned output. The power hold relay PHLD functions to close the switch PHLD shown in FIG. 26. The blank exposure lamp BEXP is lighted in an approximately inverse manner to the exposure lamp IEXP as shown in FIGS. 13 and 14 to eliminate the difference in the surface potential of the photosensitive element. The paper feed counter CNTD counts the number of completed copying and compares the counted number step advanced at each CNTD signal with a predetermined number to release a copy end signal (for switching off the copy start button) when said two numbers are equal. FIGS. 13 and 14 shows the time charts of input signals and output loads, which will be self-explanatory and not be explained in particular.

Figure 10:
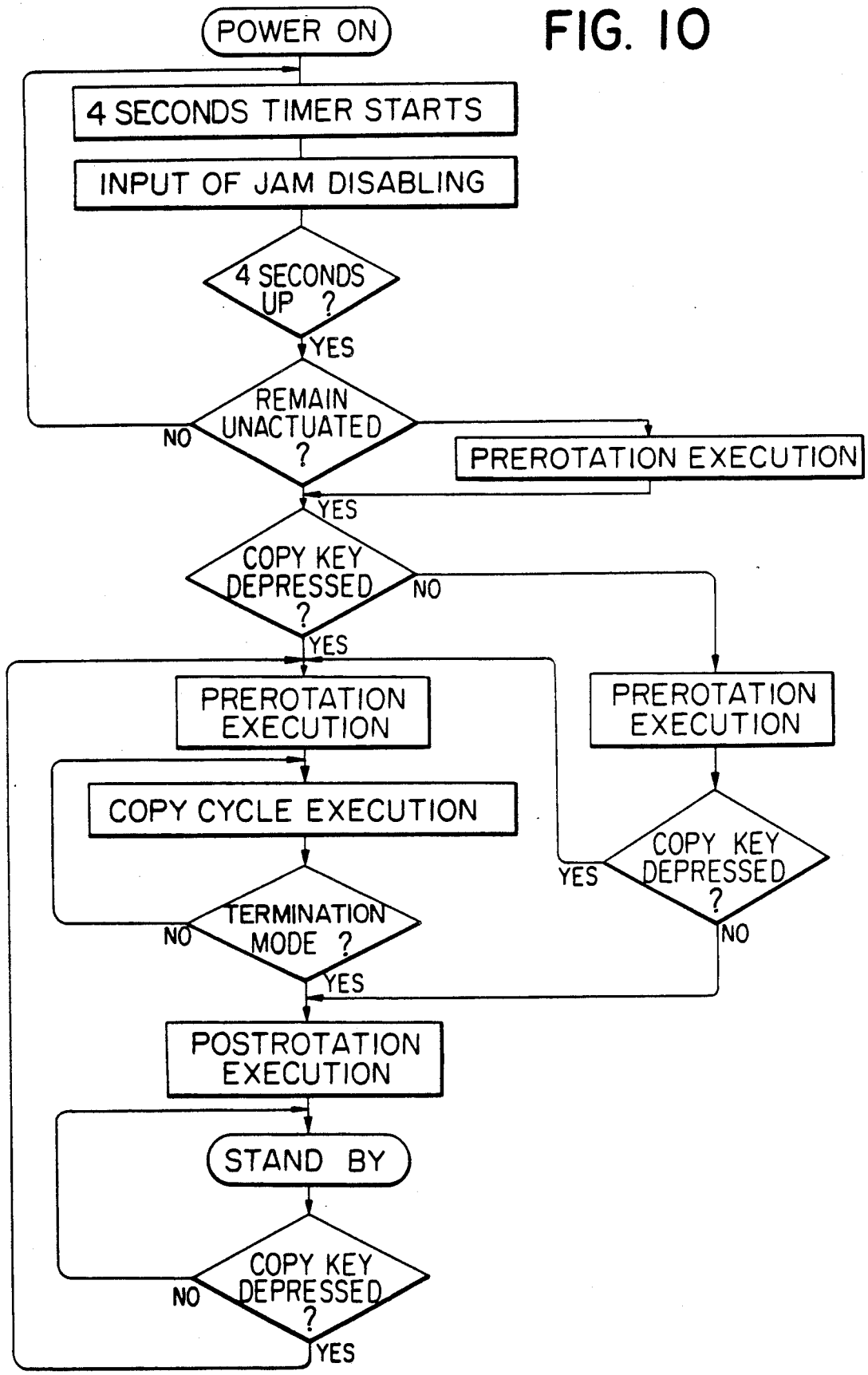
FIG. 10 is a system flow chart of the operations of the copier shown in FIG. 1.

FIG. 10 shows a system flow chart of sequence control, while FIGS. 11 and 12 show further detailed flow charts, according to which the code list shown in Tab. 2 is stored in the ROM. FIG. 10 shows the outline of steps from the power on to the process execution and stand-by.

In FIG. 10, pre-rotation and post-rotation respectively correspond to the pre-treatment and post-treatment of the surface of photosensitive drum. The pre-treatment performs the removal of toner particles remaining on the drum surface and blade to contribute to the formation of a satisfactory latent image, while the post-treatment achieves the removal of toner particles remaining on the drum surface before they become dry. Also during the pre- and post-treatments the charger is maintained in function to reduce unevenness in the surface potential. Although the blade in this embodiment is in constant contact with the drum, it may also be structured to be in contact or out of contact according to the power on or off in order to reduce the blade mark on the drum surface.

Resetting

Figure 20A:
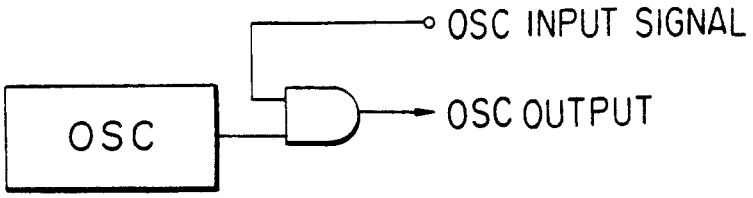
FIGS. 20A, 20B and 20C are diagrams of clock generators.
Figure 20B:
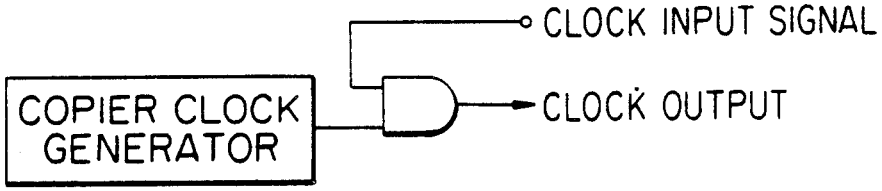
Figure 20C:
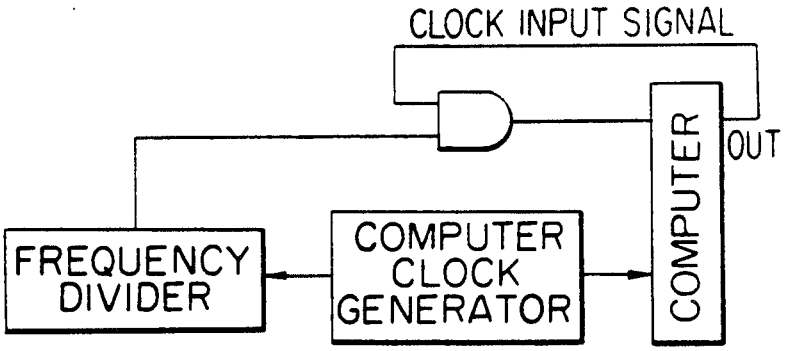

Succeeding to the power on, there is produced a power-up reset signal PURS for approximately 4 seconds for identifying the unactuated time before the power on and for resetting the entire circuit. Said period of 4 seconds is obtained by the program. As explained in the foregoing, the execution of each instruction stored in the ROM requires 6 clock pulses which are generated by the oscillator OSC in FIG. 8 at a frequency of 300 kHz, which corresponds to a period of ca. 3.3 microseconds for per clock pulse or of ca. 20 microseconds for 6 clock pulses, namely for executing one instruction. Thus a 4-second timer can be obtained by a step containing 2000,000 instructions. For this purpose, succeeding to the power on, FIGS. 15, 15, 15 and 10 are respectively stored in the Y addresses 1, 2, 3 and 4 of RAM, and the number 15 in the address 1 is successively decreased until it reaches 0, when the number 15 stored in the address 2 is subtracted by 1 to obtain a number 14. Successively a number 15 is again entered into the address 1 and again subjected to successive subtraction until it reaches 0. Each time the address 1 reaches 0 there is subtracted 1 from the content of address 2, and each time the address 2 reaches 0 there is substracted 1 from the content of address 3. The operation is repeated until all the addresses reach 0, and the total number of instructions during this operation is approximately equal to 200,000. An alternative method for realizing a 4-second timer is shown in FIG. 20. The method shown in FIG. 20A utilizes an oscillator generating signal at 1 second intervals for example, said signals being supplied to the microcomputer utilizing suitable output signals thereof. In this case the computer is only required to make four counts for an oscillator of one-second interval, with an extremely reduced number of program steps. The method shown in FIG. 20B is based on the counting of aforementioned clock pulses generated in synchronization with the photosensitive element when said pulses are of a relatively low frequency. Also the method shown in FIG. 20C is based on dividing the clock frequency for driving the microcomputer and counting thus divided frequency, said method being effective for realizing a timer of a very high precision.

Detection of Non-Actuated Period

In case the copier is left unoperated, the toner remaining on the blade cleaner tends to solidify thereon. Thus the copier of the present embodiment is designed to perform a pretreatment longer than usual (ca. 40 seconds) in case said unoperated period is 7 hours or longer.

Figures 1, 21:
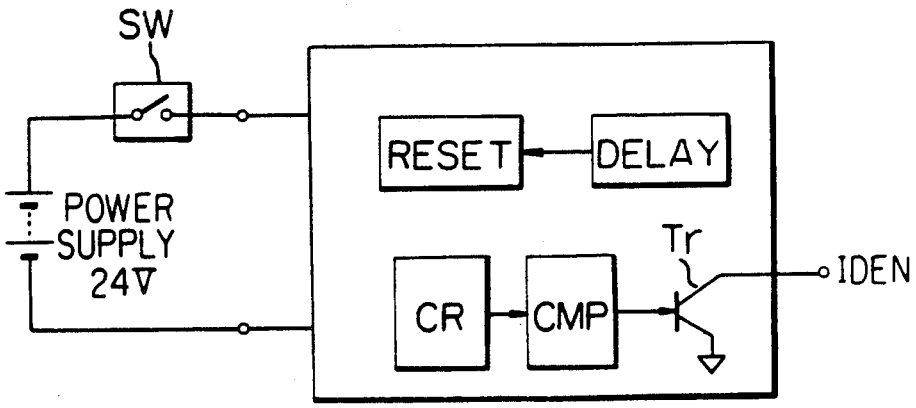
Figures 2, 21:
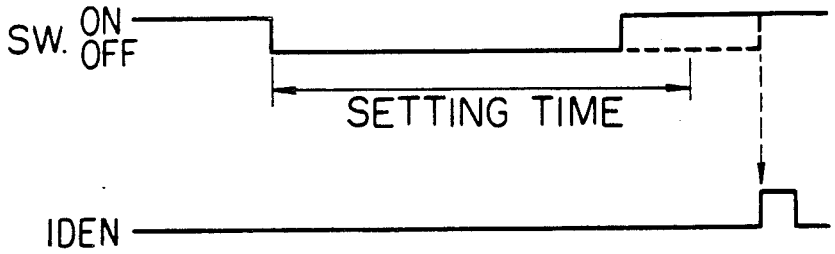

FIGS. 21-1 and 21-2 respectively show an external circuit therefor and a time chart thereof, said circuit being composed of a CR timer circuit CR, a reset circuit RESET, a delay circuit DELAY, a comparator circuit CMP and a driver circuit TR. During the function time of the copier while the main switch SW is on, the condenser of said CR timer is charged by DC 24 V. The complete charging is reached after 30 seconds of charging. Said condenser is provided with a very low leak current. When the main switch SW is turned off, the condenser starts discharging and reaches a potential which, if the unoperated period is 7 hours or longer corresponding to the drying of toner on the blade cleaner, will operate a comparator CMP at the next power on of the copier to turn on the output transistor TR during a period (ca. 10 seconds) determined by the delay circuit DELAY thereby releasing a prolonged unoperated signal IDEN. Upon termination of the delay time the reset circuit is actuated to restart the condenser charging. On the other hand, if the inoperated period is shorter than 7 hours, the comparator CMP does not function as the condenser potential is higher than the predetermined value when the switch SW is closed, so that the output transistor remains off and the signal IDEN is not released. Thus the charging of condenser is restarted. The standard time for measuring the unoperated period is determined by the capacity of condenser. Also it is possible to detect the unoperated time from the toner precipitation represented by the light transmission of liquid developer.

Flow

After the power on the STEP 1 is executed in the abovementioned manner to start the developing motor (STEP 2), which supplied the liquid developer to the contact area of blade and drum surface thereby dissolving the toner solidified on the blade or drum and facilitating the cleaning in the pre-treatment.

Then the STEP 3 identifies if the jam detection circuit should be disabled (jam disabling). In case of confirming the sequence operation without paper feeding for example in the maintenance service of the copier, the jam detection circuit should be disabled since other wise the computer will operate the jam indicating lamp and stop the sequence thereby rendering sequence confirmation impossible. For this purpose, in the present embodiment, the CP1 is shortcircuited to the ground before the power on whereby the high level (level 1) output of inverter 210 is supplied to the terminal 21' of matrix circuit shown in FIG. 15. On the other hand the matrix circuit 1' receives a level 1 signal from the output terminal 52 for 4 seconds from the power on whereby the NAND gate 314 providing a level 0 output for said 4 seconds, and the AND gate 310 providing a level 1 output during said period, because the 4-second timer is composed of the computer program and no probe signal is obtained from $\theta 1$, $\theta 2$ and $\theta 3$. Thus the NAND gate 311 releases a level 0 output.

Said level 0 signal is read in said STEP 3. As will be explained later, said signal obtained in this STEP 3 is stored in the RAM and utilized in the identification of arrival of paper in the STEP 38. Now the program proceeds to the STEP 4 to identify if the period of said 4-second timer is over, and if so, proceeds to the STEP 5 to switch on the operable loads including main motor.

In STEP 6 the program reads, 4 seconds after the power on the IDEN signal released for ca. 90 seconds from the power on by the aforementioned unactuated time measuring circuit shown in FIG. 21 to store a flag in the RAM. In this state the pulse CLKP is not generated as the photosensitive element is not yet in rotation. In case the signal IDEN is released based upon the transparency of the liquid developer, the STEP 3 should be executed after this stage.

After the termination of said 4-second period the PURS signal from the AND gate 201 changes to level 0, so that the AND gate 201 releases a level 0 output even though it receives the IDEN signal of level 1. Thus the OR gate 202 only supplies the clock pulses CLKP generated in synchronization with the photosensitive drum to the computer.

The data read by the STEP 6 after expiration of said 4-second timer is identified in the STEP 7, and, if the unactuated time is 7 hours or longer, the drum is further rotated in the STEP 8 and 9 to conduct the pretreatment for 40 seconds, during which the loads switched on in the STEP 5 are maintained active while the copy start button operation is not accepted. Also if the unactuated time is less than 7 hours, the program does not operate the 40-second timer for pre-treatment and proceeds to the STEP 10. Also before the expiration of said 40-second timer there are executed sub-routines SUB CBRV, SUB LP and SUB SIZE, for identifying the carriage being out of the normal position thereof, the absence of paper in the cassette and the exchange of cassettes of different paper sizes.

Said sub-routines are also provided in various parts in the succeeding steps.

Said 40-second timer is obtained by 80 counts of clock pulses CLKP of an interval of ca. 0.5 seconds generated in synchronization with the photosensitive element. Upon completion of the pretreatment for 40 seconds, there are counted 10 CLKP in the STEPS 10 and 11. As explained in the foregoing, in the present embodiment there is always conducted a pretreatment of one rotation regardless of the presence or absence of pretreatment for 40 seconds. Said pretreatment of one rotation is conducted after the treatment for 40 seconds, or, in the absence thereof, after the completion of PURS. The STEP 11 identifies 10 counts of CLKP in order not to initiate the copying operation until at least 10 pulses are counted even if the copy start button is pressed during the pre-treatment.

Figure 17:
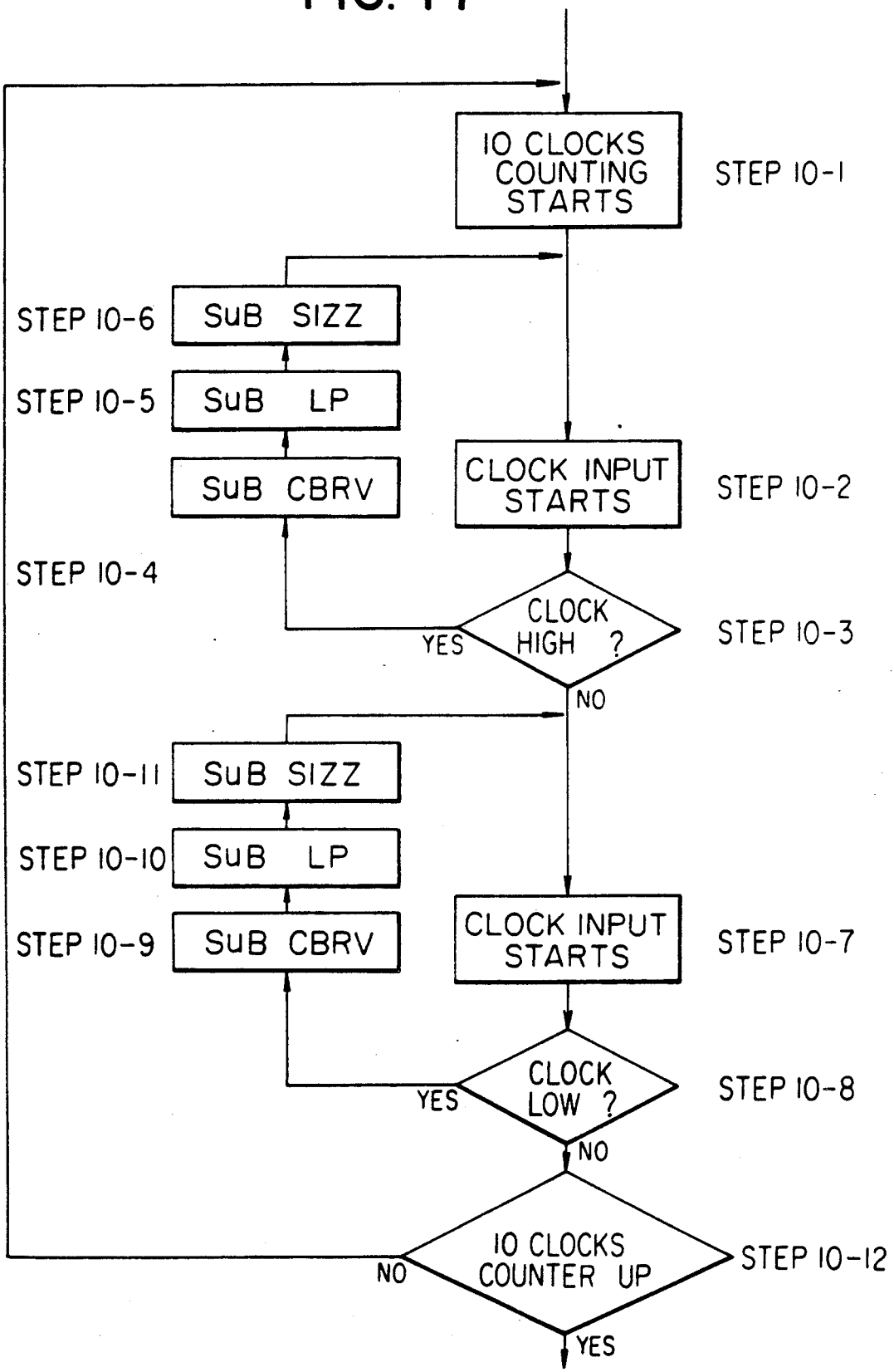
FIG. 17 is a control flow chart at a clock 1 or 0 level.

FIG. 17 shows the details of STEPS 10 and 11, wherein the STEP 10-1 starts the counting of 10 pulses and the STEP 10-2 initiates the fetching of clock pulses to identify if the clock pulse CLKP is at level 0 or 1. In case the CLKP is at level 1, the program proceeds to the STEP 10-4 to identify if the original carriage is at the home position before starting the scanning, and, if not, to release a carriage reverse motor signal (06 in FIG. 8). Also the STEP 10-5 identifies the presence or absence of liquid developer and operates the indicator if necessary, and the STEP 10-6 identifies the paper size and confirms the mounting of cassette. In case the CLKP becomes level 0, the program proceeds to the STEP 10-7 and 10-8 to repeat similar operations. One clock count is completed when the CLKP again returns to the level 1. The above procedure is repeated until 10 clock counts are confirmed in the STEP 10-12. In this manner the clock counting is performed by identifying the leading end and trailing end of the pulse.

During the above-explained 10 clock counts, other controls can be continuously performed regardless whether the clock is at the level 1 or 0.

This principle is employed as the basic control process for conducting other controls while reading CLKP, and is particularly effective in case it is necessary to perform other operations such as the detection of the original carriage being out of the home position thereof while counting clock pulses. For example even after the original carriage is reversed by a reverse position signal and the carriage reverse motor is switched off upon detection of the carriage being at the home position, the carriage may still be out of the home position for example by the eventual contact of the operator with the carriage. In such case, however, if the program is constructed in such a manner to perform the position detection solely in the level 0, for example, of the clock pulses, the reverse motor switched on during said level 0 state to return the carriage to the home position will continue to be running even if the clock pulse changes to the level 1, thus leading an overload of the motor. For this reason the routine CBRV is executed in both levels.

Upon completion of 10 CLKP counts, the STEP 12 is executed to confirm if the copy start button has been actuated. If not, the STEPS 13 and 14 are executed to count remaining 6 clock pulses for the pretreatment of one rotation. If the copy start button has been actuated, the program proceeds to the STEP 21 to execute the copying process.

Upon completion of the pretreatment of one rotation, the program proceeds to the STEP 15 wherein all the operable loads are switched off except the main motor, high-voltage source and blank exposure lamp switched on in the STEP 5, and further proceeds to the aforementioned post-treatment (A) to render the potential on the photosensitive element uniform. During said post-treatment there is generated a power hold signal PHLD to maintain the power supply to the control circuit even if the main switched is turned off.

During said post-treatment the STEP 16 is executed to identify if the copy start button has been actuated and to count 32 clock pulses for rotating the drum two turns. If the copy start button has been actuated, the program proceeds to the STEP 21. Upon completion of the post-treatment the copier enters a stnad-by state. For this reason all the loads are turned off in the STEP 19. During the stand-by state, the STEP 20 is executed to constantly identify the actuation of copy start button. If the copier is left in said stand-by state for a prolonged period, the toner particles remaining on the blade cleaner tend to solidify due to a high temperature in the machine, eventually giving an undesirable effect to the succeeding image formation. For this reason, in the stand-by state, the means shown in FIG. 20 counts the clock pulses and cut off the main switch after several minutes.

The actuation of the copy start button is identified by the STEPS 12, 16 and 20, and the program proceeds to the STEP 21 to switch on the operable loads shown in this step, initiates the drum rotation and counts 9 clock pulses in order to avoid a drum area which may undesirably affect the image formation. The STEP 22 identifies if the copy instruction is interrupted by the actuation of the stop button (not shown) or by returning the dial 12 to "0". If not, after said 9 clock counts, there is generated in the STEP 24 a CBFW signal from the output 05 to start the forward displacement of the original carriage. Since the minimum paper size is B5, the carriage at first reaches the reverse position for the size B5 to release a corresponding signal B5BP. Also a paper feed signal PESP is obtained from a Hall element provided in front of said reverse position for the size B5. Upon confirmation of paper feed signal B5BP in the STEP 26, the STEP 27 executes the sub-routine SUB TSL for detecting the concentration of liquid developer. If a low concentration is found in this state, a flag for no toner is set in the RAM, and is utilized in the sequence processing to be explained later. Then the STEP 28 executes the paper size routine to identify the paper size of the mounted cassette.

As explained in the foregoing, the paper size signal is obtained by the combination of microswitches MS1 and MS2. Said two microswitches provide four combinations, of which three are utilized for three different paper sizes while the remaining one is utilized in the present embodiment for indicating the absence of cassette.

Upon identification of the paper size in the STEP 28, a size flag is set in the RAM and the program branches to either one of the flows for the sizes B5, A4 and B4 (FIG. 12). It is to be noted that an improved pre-cleaning of drum surface can be achieved by rotating the drum for more than 9 pulses after the actuation of the copy start button.

In the following an explanation will be given on the case of copying of B4 size.

In FIG. 12, the STEP awaits the passing of the carriage through the reverse position for size B5. As the magnet mounted on the carriage for detecting the reverse position is provided with a certain width, the passing thereof on the Hall element requires a certain period (several hundred milliseconds), during which the microcomputer executes the aforementioned paper size identifying routine, and thus awaits the passing of carriage through the reverse positions other than for the desired paper size.

More specifically, in case of A4 copying, the passing of carriage through the B5 reverse position is identified by the leading and trailing ends of a signal from the Hall element for said position, and in case of B4 size the passing through the A4 and B5 reverse positions is identified by detecting the leading and trailing ends of signals from the corresponding Hall elements (STEPS 84, 85, 86). Upon the arrival of original carriage at the reverse position for size B4 being identified by the STEP 87, the STEP 88 is executed to turn off the carriage advance signal CBF and the blank exposure lamp BEXP, and to release the carriage reverse signal CBRV.

Then the STEP 89 executes the jam detection routine PDP 1 to identify if the paper detector 180 (FIG. 1) detects a paper when the original carriage arrives at the reverse position for size B4, and if the paper ejected in the preceding copy process still remains in the machine, to stop the advancement of process steps, to give an alarm and to stop the succeeding paper feed. This procedure is effective in case of continuous copying.

In case of absence of paper jamming, the STEP 90 identifies if the original carriage has returned to the home position, and, if yes, the reversing of carriage is stopped in the STEP 91. Then the program proceeds to the STEP 92 for executing the routine PDP 2 for identifying the paper delay jam.

Also between the identifications of B4BP and of carriage stop position there is executed the sub-routine TSSD for resetting the flag set in the RAM by the routine TSL in the STEP 27 when the concentration of liquid developer is restored in the execution of the STEPS 87 and 90.

In contrast to the STEP 89 for identifying the absence of jamming of the preceding paper, the STEP, the jam detecting routine PDP 2 in the STEP 92 is a delayed jam detection for detecting the default in the proper advancement of paper presently in the steps of transfer and ejection. If the transfer paper has not arrived at the jam detector at the time of STEP 92, there is released a delay alarm to stop the succeeding paper feed or to stop the machine. In case no jam is found in the STEP 92, the program proceeds to the STEP 93 to identify if the copy start button is still actuated or has been reset thereby identifying single or multiple copying. In case of a single copying there are executed the STEPS 94 and 95 for counting 7 clock pulses for regulating the timing to initiate the post-treatment A. Said post-treatment is initiated after fewer number of clock pulses in case of a shorter paper, for example size B5, which is ejected quicker than the longer size, for example B4. Stated differently the post-treatment is initiated approximately when the trailing end of paper passes through the ejecting rollers regardless of the paper size.

Also it is possible to modify the timing in such a manner that the post-treatment is initiated regardless of the paper size, namely at a given number of clock pulses after the carriage reverse position for size B5.

The STEP 96 executes the routine TEL for identifying the absence of replenishing toner. This routine identifies the toner concentration when the flag set in the STEP 27 by a low developer concentration at the reverse position for size B5 could not be reset in the subroutine SUB TSSD at the STEP 87 or 90 due to a still low developer concentration, and releases an alarm for no toner if the concentration of developer still continues to be low. Since the period from the reverse position for size B5 to the post-treatment is sufficiently long, the concentration of liquid developer can be immediately restored to the predetermined value after the replenishment as long as the replenishing toner exists. The input signal TSC at this point indicates the low concentration for a prolonged period, namely the absence of replenshing toner.

Figures 1, 19:
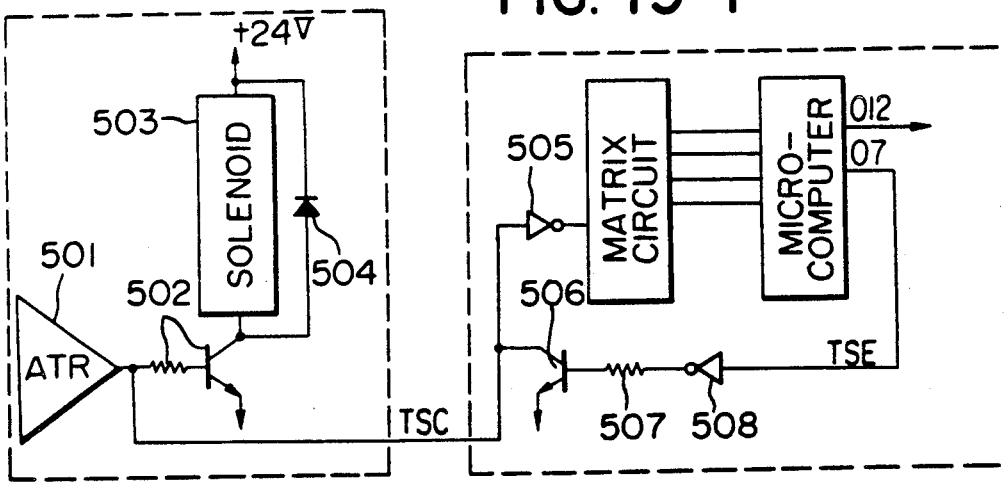
Figures 2, 19:
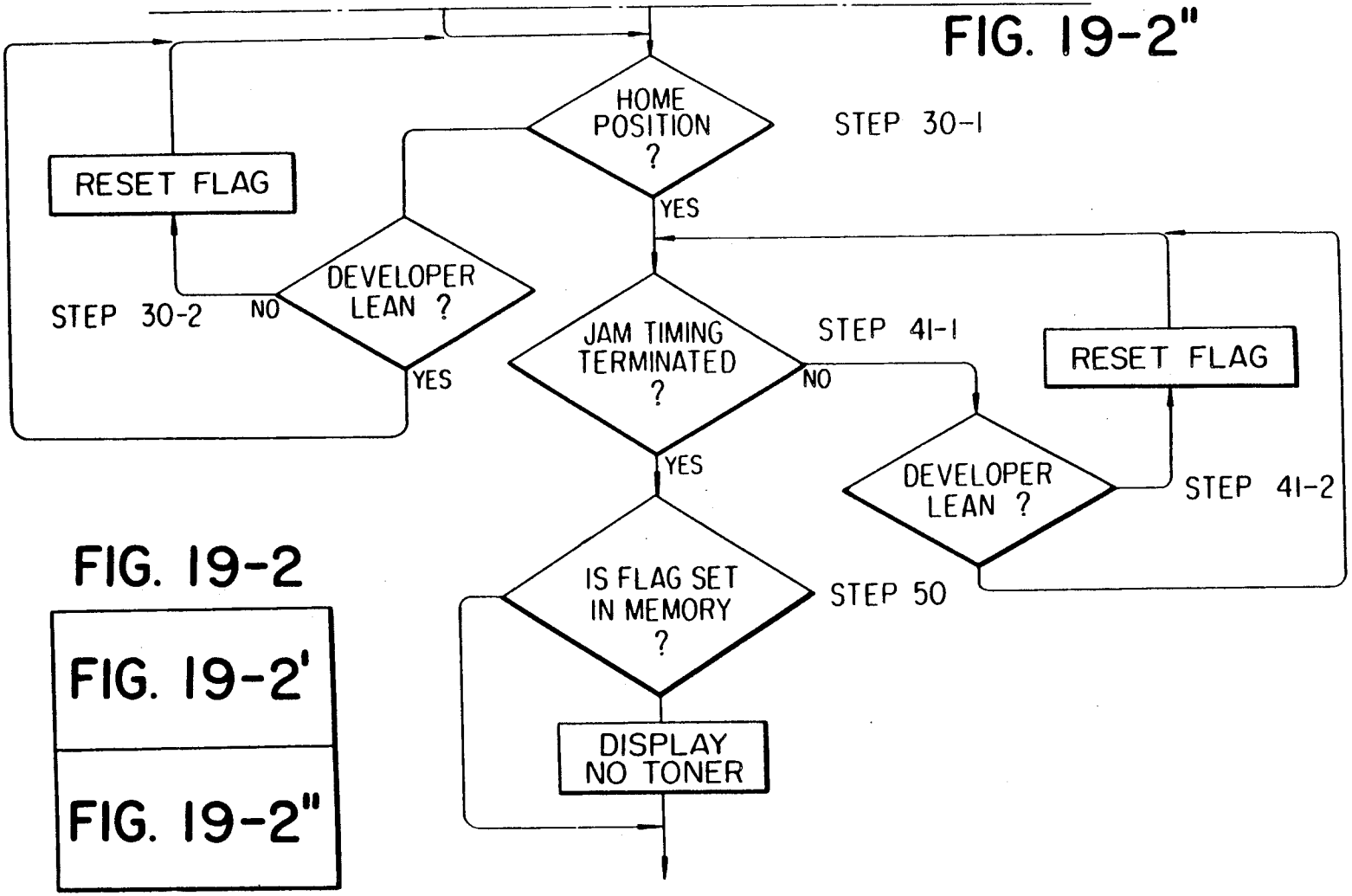
Figures 2, 19:
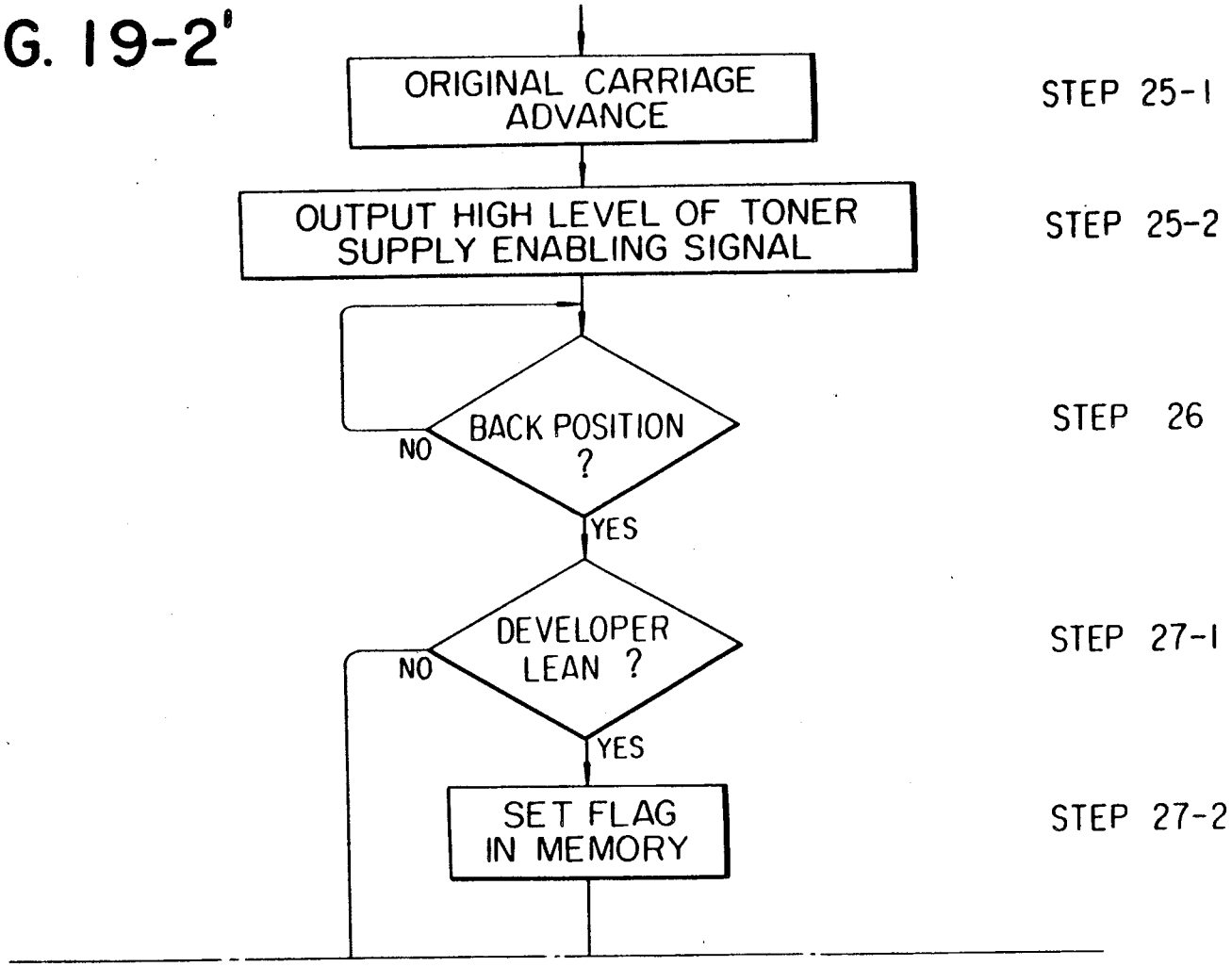

The above-mentioned procedure is detailedly explained with reference to the circuit ATR shown in FIG. 19-1 and the flow chart shown in FIG. 19-2, indicating the case of size B5. Referring to FIG. 19-1, there is shown a circuit 501 for identifying the developer concentration which releases a level 1 output if the developer concentration is low. The replenishment of toner is possible during a period from the advancement of original carriage to the post-treatment. In case the toner replenishing period is not fixed in such a manner, there may result a possibility that signals of low concentration are released each time the main switch is actuated if it is repeated switched on and off. This is possible because the developer concentration is detected by the change in resistance of a photo-detector receiving a light passing through the developer in a slit, and, when the main switch is turned on, the lamp emitting said light is turned on before the developer is introduced into said slit by the developing motor, resulting in a signal same as in the case of low developer concentration and in an erraneous toner replenishment. In this manner the developer concentration becomes abnormally elevated to give an undesirable effect on the image in case the main switch is repeatedly turned on and off.

In the illustrated circuit, even when the circuit 501 supplies a level 1 output, the signal TSC is shortcircuited to the ground because the transistor 504 is maintained in ON state as the computer output 07 is in level 0 to cause the inverter 508 to release a level 1 output.

When the original carriage is advanced by the STEP 25-1, there is released in the succeeding step a toner supply abled signal. At this stage the output of inverter 508 changes to level 0 to turn off the transistor 506, whereby the level 1 output of the operational amplifier 501 is supplied to the transistor 502 to operate a toner supply solenoid 503.

In case of the absence of toner, the level 1 output of operational amplifier 501 and the level 0 output of inverter 505 cause, through the matrix circuit, an information for low concentration to be entered into the computer. Namely in case a flag for no toner is set in the RAB at the TSL routine of STEP 27 and is not reset by the routine TSSD in the STEPS 30 and 41, the routine TBL in the STEP 50 after the jam identification and before the post-treatment identifies said flat to indicate the absence of toner. The above-mentioned STEP 50 is replaced by STEP 96 in case of size B4.

Upon completion of jam detection and no-toner detection, the program proceeds from the STEP 50 or 96 to the part (A) in FIG. 11 to initiate the aforementioned post-treatment.

In case of multiple copying, upon returning of the carriage to the home position, and upon identification of actuation of the copy start button in the STEP 93, the program proceeds to the part (C) in FIG. 11 to restart the advancement of original carriage and to thereafter repeat the above-explained procedure.

Although the program sequence has been explained with respect to the copy size B4, the sequences for the sizes B5 and A4 are also similarly executed with certain differences in the jam detecting process and will not, therefore, be explained.

Figures 1, 18:
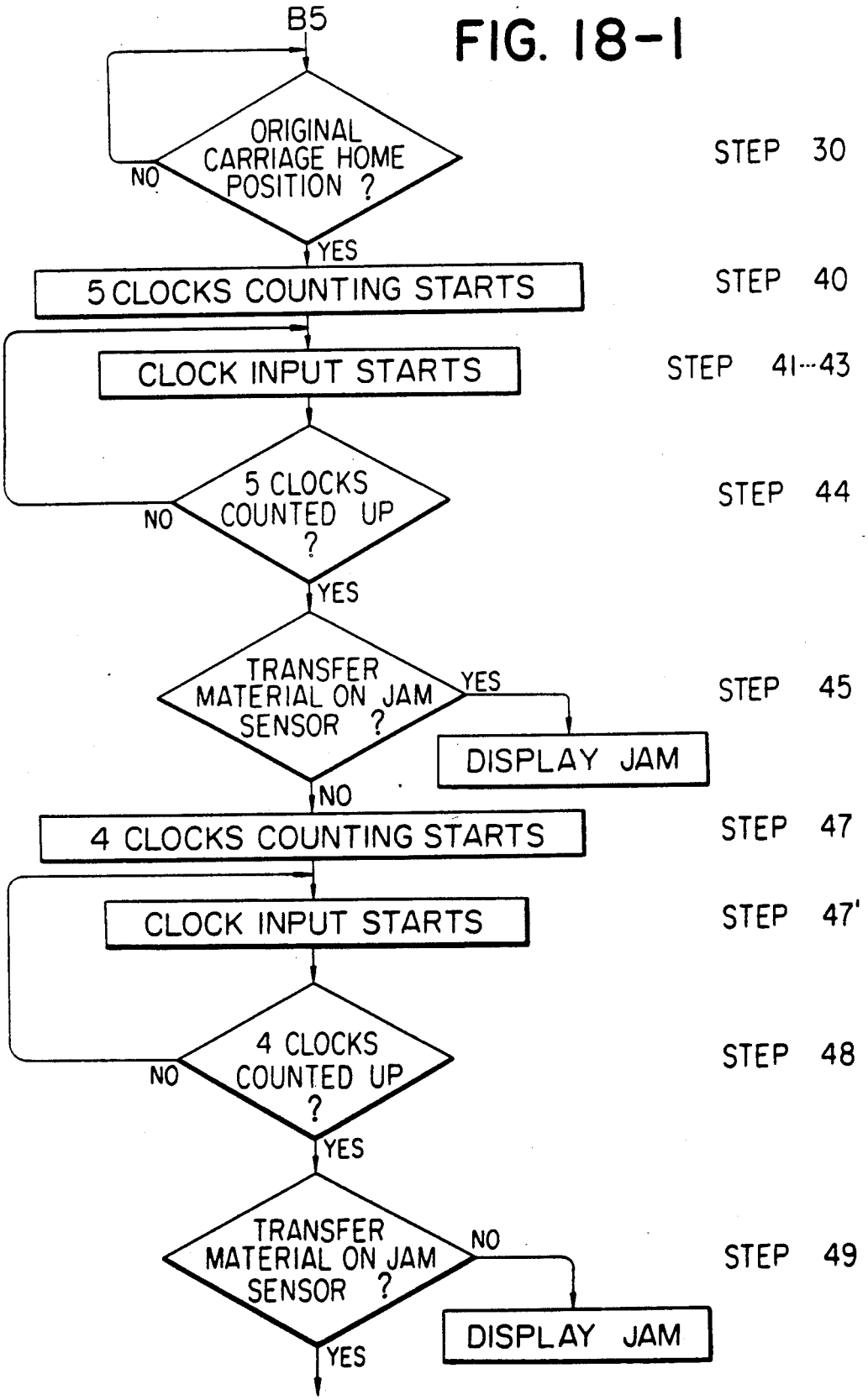
Figures 2, 18:
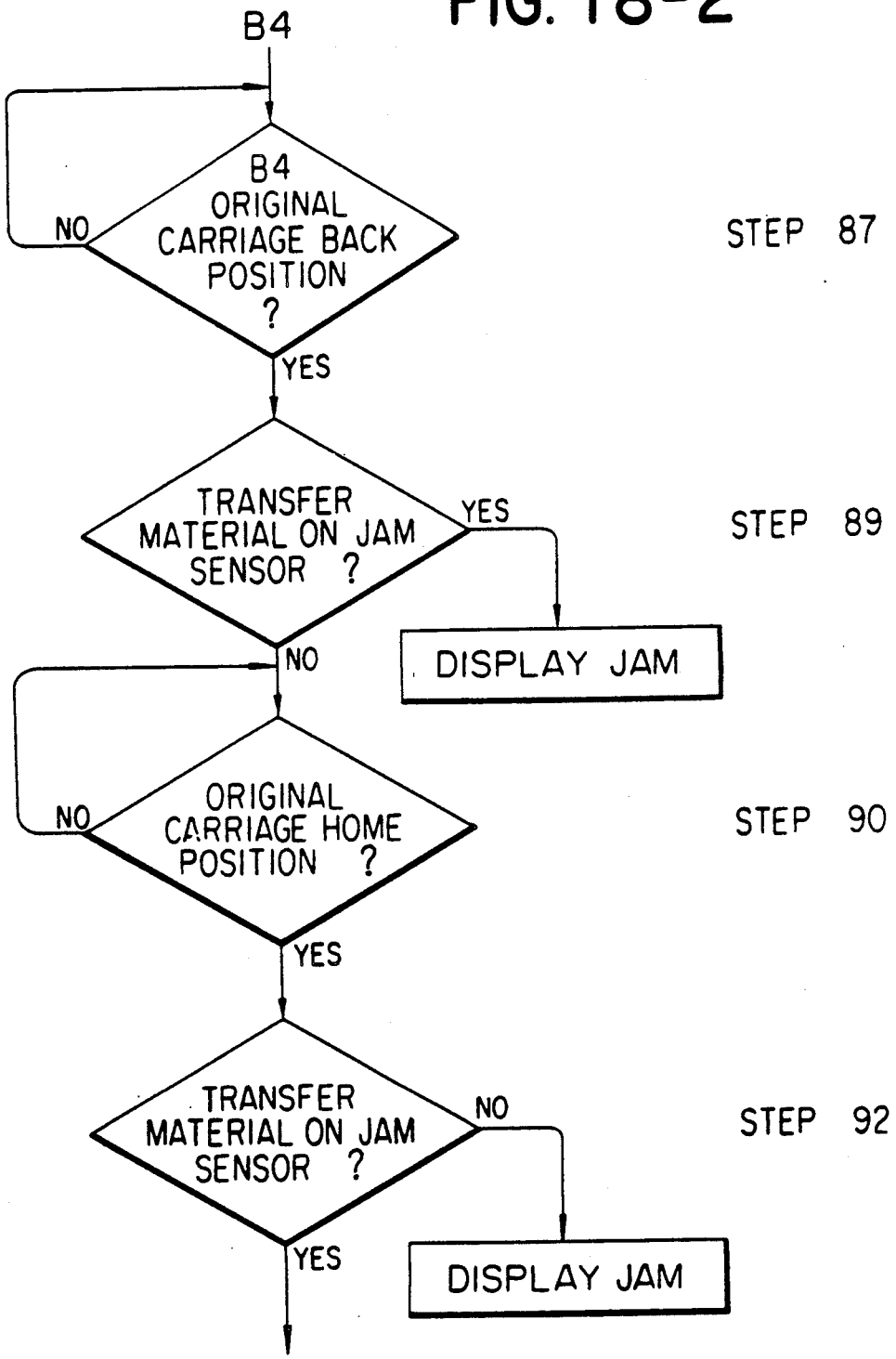
Figures 3A, 18:
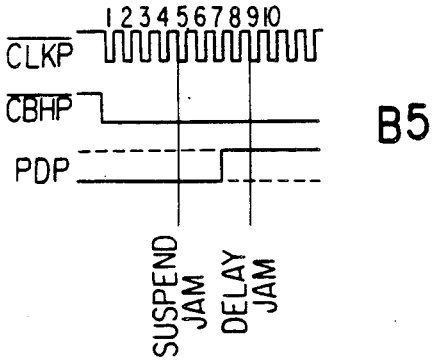

Now there will given a detailed explanation on the jam detection while making reference to FIG. 18. In case of size B5 (FIG. 18-1), upon arrival of the carriage at the home position in the STEP 30, the program proceeds to the routine (I) shown in FIG. 12 to count 5 clock pulses, then identifies in the STEP 45 if the preceding paper is present on the paper detector 180, and, if no, further counts 4 clock pulses to identify if the transfer paper has reached the paper detector 180. In case of arrival the Hall element 129 releases a level 0 signal as shown in FIG. 23C, indicating approper paper feeding.

Figures 3C, 18:
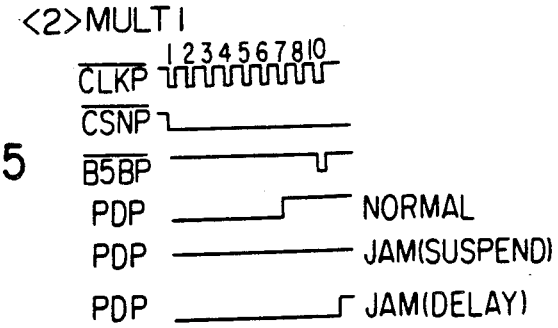
Figures 3B, 18:
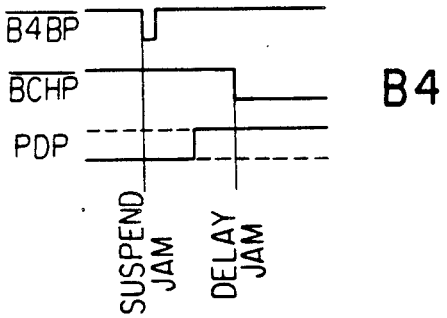

On the other hand the sequence for size B4 is shown in FIG. 18-2. In these sequences, as shown in the time charts of FIG. 18-3, clock pulses are utilized in the size B5 while the B4 reverse position signal and stop position signal are utilized in the size B4. As the jam detection is performed in this manner by the clock pulses or the carriage signals according to the sizes, a convenient control can be achieved even when the jam identification is close to the load operation. Further, as shown in FIG. 18-3C, in case of multiple copying in size B5, the delay identification is conducted by B5BP while the detection for the last copy is conducted by the clock pulses.

Furthermore, though the jam detection for sizes B5 and A4 in the present embodiment is conducted by means of clock pulses, it is also possible to utilize pulses obtained by dividing drive pulses for microcomputer or an external low-frequency oscillator.

In the present embodiment the jam detection operations can be disabled by shortcircuiting CP1 (JAMK) to the ground, and this can be achieved by means of ten keys for electrical input of copy number etc. Namely the input signals for jam detection disabling, developer detection disabling (to disregard the identification of signal LEP), paper detection disabling (to disregard the identification of signal PEP) etc. are coded and entered before the STEP 4 in FIG. 11 to set a flag in a particular address in the RAM, and in the program there are provided, before the steps of detecting jam, developer and paper, steps for skipping said detecting steps. During the execution of program said steps read the RAM addresses storing said disabling data to identify if the flag is 1 or 0, and proceeds to said detecting steps in case the flag is 0 or skips said detecting steps in case the flag is 1.

Figure 24:
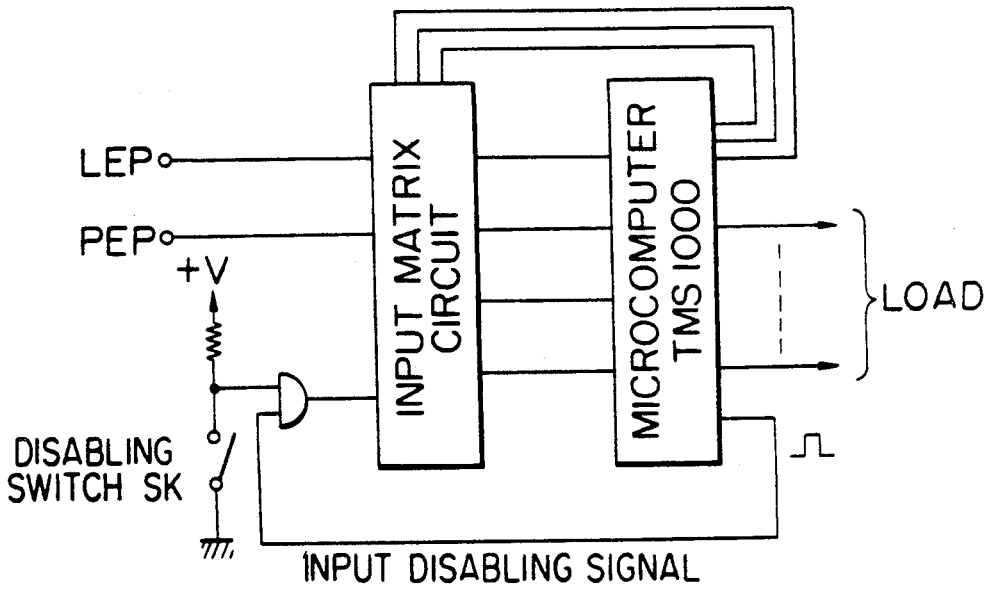
FIG. 24 is a diagram of an example of the disabling circuit for various tests.
Figure 25:
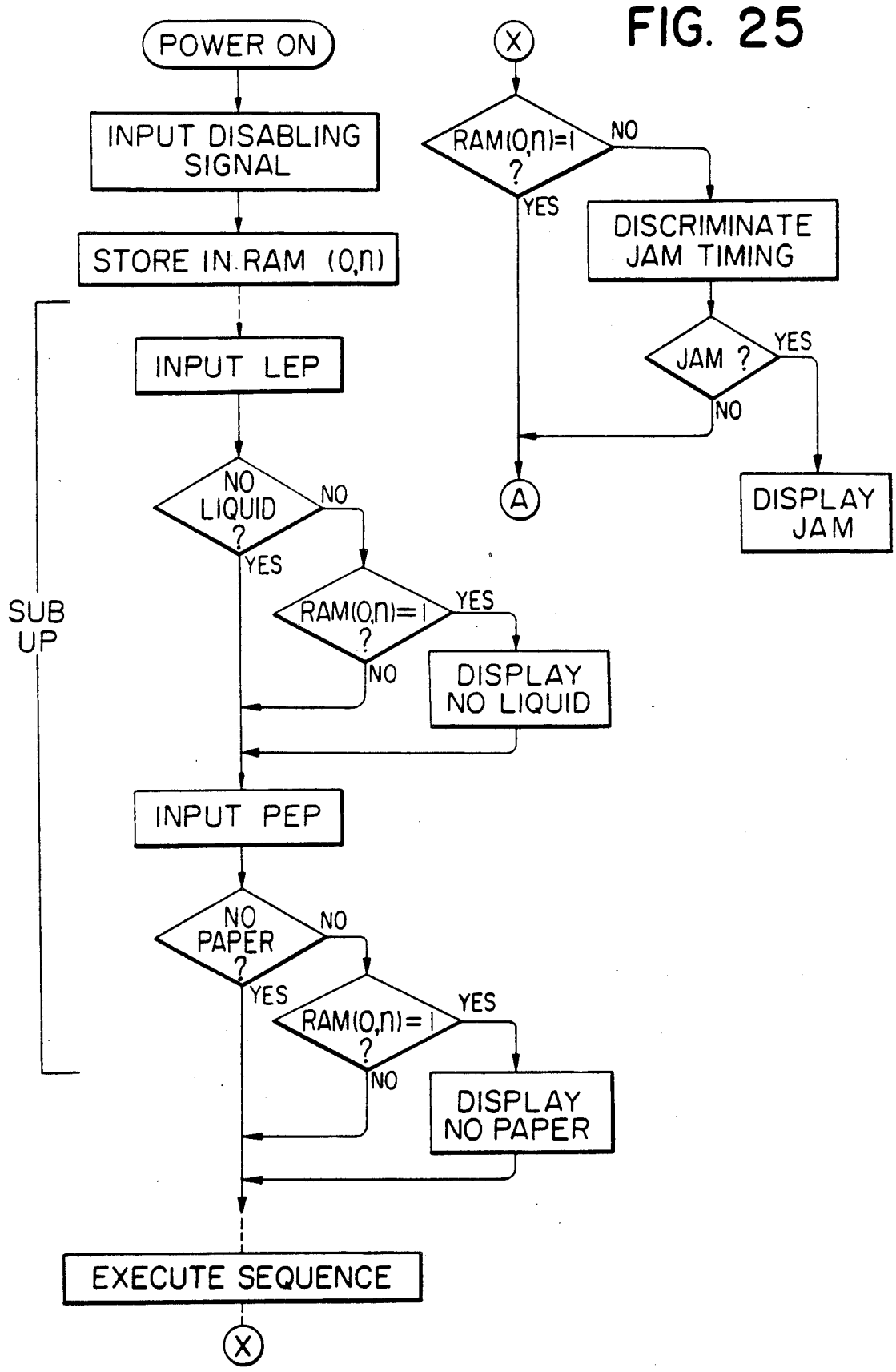
FIG. 25 is a control flow chart for of disabling for various tests.

FIG. 24 shows a circuit similar to FIG. 6, wherein the terminals LEP and PEP respectively receive level 1 inputs in case of no developer or paper. SK is a disabling switch for various detections, which may be for example connected to JAMK in FIG. 6. The illustrated example performs the disabling of LEP, PNP and jam detection simply by grounding said switch SK. Referring to the flow chart shown in FIG. 25, the disabling instruction is identified during 4 seconds as in the case of FIG. 6, and the instruction is stored in the RAM address (0, n) as a 0 data. The routines LP executed as sub-routines in the process steps identify LEP, and, in case of no developer, identify the 0 data in the RAM address (0, n) to omit the indication for no developer. The signal PEP is also similarly processed. Thereafter the step for jam detection identifies the 0 data in the RAM (0, n) and, if the data is 0, omits the jam detection step.

According to the present invention, the original carriage is automatically reversed at the longest paper size even when the magnetic detecting elements for the sizes B5 and A4 are damaged, but in case of a failure of the magnetic detecting element for detecting the carriage reverse signal for longest paper size there may result an overload on the carriage advance motor because of lack of reverse input.

In order to avoid this trouble there is provided a timer of a fixed time from the start of advancement of carriage to the arrival thereof to the reverse position for the longest paper size by counting CLKP. For example this can be achieved by providing, in each BP detecting routine, a routine for counting CLKP to the B4BP of a B4BP detecting routine to reverse the carriage by either detection. As the paper size flag is memorized as aforementioned, the carriage can be automatically reversed in case the predetermined reverse signal is not released after counting determined number of CLKP for a given paper size. Said timer can be obtained by counting CLKP as explained above, or by counting the pulses from an external low-frequency oscillator or pulses obtained by dividing the frequency of microcomputer drive clock pulses.

Tab. 2 shows an example program codes showing the flows shown in FIGS. 11 and 12, wherein the instructions are same as explained in the User's Manual for TMS 1000.

Now there will be given an explanation on the power supply circuit to the microcomputer shown in FIG. 22. Said circuit is composed of a 15 V stabilized supply and a 15 V shut-off circuit.

In the present embodiment there is provided a control step for releasing a power hold signal for the post-treatment in order that the power supply to the drum rotation or other operable loads are only cut off after the completion of post-treatment even if the main switch is turned off during said post-treatment after a copy cycle. For this purpose, in a power transformer 260 for supplying a DC current to the control circuit and other DC loads, there is provided a condenser of a very high capacitance (for example 2200 $\mu$F) in the smoothing circuit of the 24 V rectifying circuit in the secondary side, and, in the primary side, there are provided a line receiving AC 100 V through said main switch and an another line receiving AC 100 V even when the main switch is turned off during the post-treatment. Said circuit is controlled by the aforementioned power hold signal PHLD even when said main switch is turned off during the post-treatment. Furthermore it is possible to retract the blade cleaner from the drum upon termination of said signal PHLD and bring said cleaner in contact with drum upon reclosing of the main switch.

In case the main switch is turned off during the post-treatment and the subsequently released power hold signal is thereafter terminated upon completion of the post-treatment, the primary side, and likewise the second side of power transformer are accordingly turned off. In such case, due to the presence of smoothing condenser 261 requiring a considerably long discharge time (several hundred milliseconds), and also due to the operable voltage margin of the microcomputer, there may start erraneous functions of RAM, ROM etc. of the microcomputer as the power supply voltage gradually decreases, and an erraneous power hold signal eventually released by the functions of RAM and ROM may revive the aforementioned power supply line despite the completion of post-rotation.

In such case the other RAM addresses may naturally be incorrect, eventually resulting in, for example, the function of jam indicating lamp.

Figure 22:
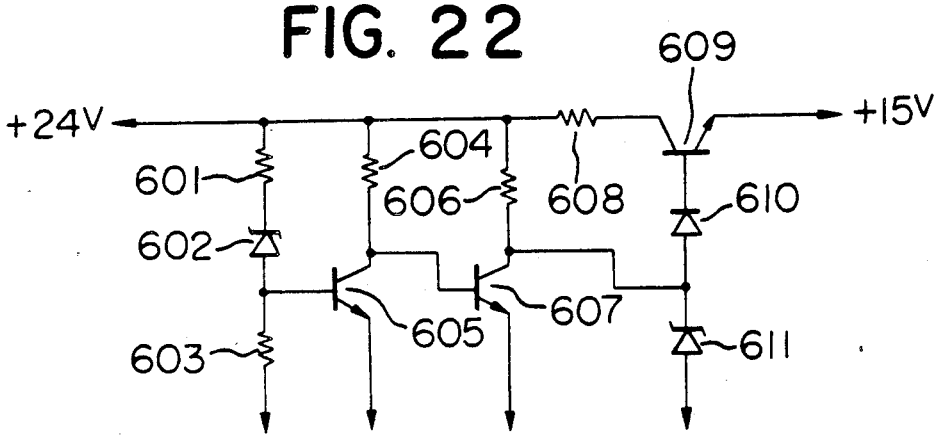
FIG. 22 is a diagram of a power supply circuit.

FIG. 22 shows a shut-off circuit for avoiding the abovementioned trouble, wherein there are shown a resistor 601 for passing Zenar current, a Zenar diode (20 V) 602, an NPN transistor 605, a collector resistor 604, an NPN transistor 607, a collector resistor 606, a voltage drop resistor 608, a 16 V Zenar diode 611, a silicon diode 610 and a control transistor 609.

The resistor 608, transistor 609 and Zenar diode 611 form a known constant-voltage circuit. The Zenar voltage of Zenar diode 602, which is ca. 20 V, is supplied to the base of transistor 605 through the resistor 601. The input and output terminals of said circuit are respectively connected to the smoothing circuit for transformer output and to the computer power supply terminal. In case said circuit receives a 24 V, namely during the execution of post-treatment, the Zenar diode 602 has a Zenar current to maintain the transistor 605 in conductive state whereby the collector is maintained at approximately zero potential by the current through the resistor 604. On the other hand the transistor 607 is not conductive because of absence of base current supplied through the resistor 604. Consequently the current in the resistor 606 is limited to the Zenar current supplied to 611, whereby the voltage across the Zenar diode 612 is maintained at a Zenar voltage of 16 V to supply an output of 15 V. Now, when the input voltage gradually decreases from 24 V as mentioned in the foregoin after the completion of post-treatment to reach ca. 20 V, the Zenar diode 602 becomes non-conductive to render the transistors 605 and 607 respectively non-conductive and conductive, whereby the collector of transistor 607 reaches approximately zero potential, thus giving no Zenar current in 611 and providing zero output voltage.

The diode 610 is provided for stopping the inverse voltage momentarily applied between the base and emitter of transistor 609.

In this manner said circuit automatically shuts off the power supply when the supply voltage decreases from 24 V to about 20 V.

Such circuit, therefore, is extremely effective not only to control circuit for image forming but also similar control circuits containing memories even when the smoothing circuit has a very large discharge time constant.

Although the present invention has been explained with respect to an embodiment thereof applied to a transfer type copier, it is also applicable to those of so-called fax type or TESI type. Furthermore it is also applicable to color copiers and screen retention copiers wherein the aforementioned recording element corresponds respectively to a drum for forming color-separated latent image in the former or to an insulating drum for forming a secondary latent image based on a screen image.

What we claim is:

1. An image processing apparatus, comprising:

process means for image processing;

computer control means having a memory storing therein a program for controlling said process means, for producing various control signals for the image processing on the basis of said program;

means for generating clock pulses employed to execute the program of said computer control means; and means for dividing said clock pulses;

wherein said computer control means receives the clock pulses divided by said dividing means in order to count said divided clock pulses, and controls a process sequence in accordance with the count.

2. An apparatus according to claim 1, wherein said computer control means determines an operational timing of said process means in accordance with the count.

3. An apparatus according to claim 1, further comprising input control means for controlling the input of said clock pulses divided into said computer control means.

4. An apparatus according to claim 3, wherein said input control means operates responsive to a predetermined signal from said computer control means.

5. An apparatus according to claim 4, wherein said input control means is a gate circuit.

6. An image processing apparatus comprising:

process means for image processing;

computer control means having a memory storing therein a program having instructions for controlling said process means, for producing control signals; and means for generating clock pulses employed to execute the program of said computer control means, wherein said computer control means processes one instruction in the program on the basis of predetermined clock pulses of said clock pulse generating means and includes timer means which produces a timer signal on the basis of counted pulses derived by frequency-dividing said clock pulses of said clock pulse generating means and said counted pulses having a frequency lower than that of the said clock pulses.

7. An apparatus according to claim 6, wherein said timer means counts the low frequency pulses by the program in said memory.

8. An apparatus according to claim 7, wherein said control signals are for controlling the image processing.

* * * * *